US006744416B2

(12) United States Patent
Mizutani et al.

(10) Patent No.: US 6,744,416 B2
(45) Date of Patent: Jun. 1, 2004

(54) FIELD SEQUENTIAL LIQUID CRYSTAL DISPLAY APPARATUS

(75) Inventors: Yasushi Mizutani, Hamura (JP); Hisashi Aoki, Hamura (JP); Haruo Wakai, Tokyo (JP); Shingo Yamauchi, Hachioji (JP)

(73) Assignee: Casio Computer Co., Ltd., Tokyo (JP)

( * ) Notice: Subject to any disclaimer, the term of this patent is extended or adjusted under 35 U.S.C. 154(b) by 225 days.

(21) Appl. No.: 10/032,187

(22) Filed: Dec. 21, 2001

(65) Prior Publication Data

US 2002/0113761 A1 Aug. 22, 2002

(30) Foreign Application Priority Data

Dec. 27, 2000 (JP) ..... 2000-399157

(51) Int. Cl.[7] ..... G09G 3/36

(52) U.S. Cl. ..... 345/88; 345/690; 345/102; 362/30

(58) Field of Search ..... 345/82, 83, 690, 345/87, 102, 88, 92, 97; 349/61; 362/30

(56) References Cited

U.S. PATENT DOCUMENTS 5,561,539 A * 10/1996 Funahata et al. ..... 349/70
5,724,062 A * 3/1998 Hunter ..... 345/102
5,754,160 A * 5/1998 Shimizu et al. ..... 345/103
6,243,068 B1 * 6/2001 Evanicky et al. ..... 345/102
6,448,951 B1 * 9/2002 Sakaguchi et al. ..... 345/88
6,608,614 B1 * 8/2003 Johnson ..... 345/102

* cited by examiner

*Primary Examiner*—Amr Awad
(74) *Attorney, Agent, or Firm*—Frishauf, Holtz, Goodman & Chick, P.C.

(57) ABSTRACT

A field sequential type liquid crystal display apparatus includes a liquid crystal display device in which unit-color image data of different colors are sequentially written in display elements during the period of one frame composed of three continuous fields, and an illuminating unit placed at the back of the liquid crystal display device to sequentially emit light beams having colors corresponding to the colors of the unit-color image data in accordance with the sequential write of the unit-color image data. The illuminating device is selectively controlled to sequential turn-on of colors, total turn-off by which the emission of all the light beams is stopped, or total turn-on. A semitransparent reflecting film is formed between the liquid crystal display device and the illuminating unit.

19 Claims, 8 Drawing Sheets

FIELD SEQUENTIAL LIQUID CRYSTAL DISPLAY APPARATUS

CROSS-REFERENCE TO RELATED APPLICATIONS

This application is based upon and claims the benefit of priority from the prior Japanese Patent Application No. 2000-399157, filed Dec. 27, 2000, the entire contents of which are incorporated herein by reference.

BACKGROUND OF THE INVENTION

1. Field of the Invention

The present invention relates to a field sequential liquid crystal display apparatus.

2. Description of the Related Art

A field sequential liquid crystal display apparatus has a construction in which a liquid crystal layer is sandwiched between a pair of front and rear substrates. Electrodes are formed on the opposing inner surfaces of these substrates. This apparatus comprises a liquid crystal display device, a plurality of light-emitting elements, and an illuminating unit. The liquid crystal display device forms a plurality of display elements which control the transmission of a light beam in a region where the electrodes of the pair of front and rear substrates oppose each other. The light-emitting elements are arranged at the back of this liquid crystal display device and emit light beams having a plurality of unit colors (e.g., three colors of red, green, and blue). The illuminating unit allows these unit-color light beams emitted by the light-emitting elements to enter the liquid crystal display device from the back side. To display an arbitrary color by temporal color mixing of a plurality of unit colors in the apparatus having this configuration, unit-color image data signals corresponding to these unit colors are sequentially supplied to the liquid crystal display device in each field for displaying one of these unit colors. During the period of one frame composed of a plurality of continuous fields, equal in number to the unit colors, for sequentially displaying different unit colors, the unit-color image data are sequentially written in the display elements of the liquid crystal display device. In addition, in accordance with this sequential write of the unit-color image data, the light-emitting elements of the plurality of unit colors are sequentially turned on. In this way, a color image (full-color image or multi-color image) is displayed.

In this field sequential liquid crystal display apparatus, the liquid crystal display device need not be equipped with any color filter, so there is no color absorption by the color filter. Also, this apparatus displays a color image by sequentially writing unit-color image data into all the display elements of the liquid crystal display device. Therefore, the apparatus can display bright, high-resolution color images compared to a liquid crystal display apparatus in which color filters of a plurality of colors corresponding to individual display elements of a liquid crystal display device are alternately arranged.

In the above field sequential liquid crystal display apparatus, one frame for forming one image is made up of three fields which display three colors, red, green, and blue. That is, one field for displaying one color is ⅓ of one frame, so data corresponding to one color must be written in and displayed by the liquid crystal display device in one field. Therefore, the liquid crystal display device is required to have high-speed response characteristics.

Accordingly, as the liquid crystal display device used in the field sequential liquid crystal display apparatus, the use of a liquid crystal display device using a ferroelectric liquid crystal capable of high-speed response, or a liquid crystal display device having a liquid crystal layer in which liquid crystal molecules are bent, has been proposed.

Unfortunately, in the liquid crystal display device using a ferroelectric liquid crystal, it is difficult to obtain uniaxial alignment in which liquid crystal molecules are evenly aligned in one direction. In the liquid crystal display device having a liquid crystal layer in which liquid crystal molecules are bent, it is difficult to obtain a liquid crystal layer in which liquid crystal molecules are stably, evenly aligned. In either case, no liquid crystal display device having stable operating characteristics and high-speed response characteristics can be obtained.

Also, the field sequential liquid crystal display apparatus always displays a color image by sequentially writing unit-color image data into the display elements of the liquid crystal display device, and sequentially turning on a plurality of light-emitting elements of the illuminating unit in accordance with this data write. This increases the number of times of data write for causing the liquid crystal display device to display one image. Since this raises the field frequency and the frequency of each signal, the power consumption also increases.

BRIEF SUMMARY OF THE INVENTION

It is an object of the present invention to provide a field sequential liquid crystal display apparatus using a liquid crystal display device having stable operating characteristics and high-speed response characteristics.

To achieve the above object, the present invention is achieved by the use of a liquid crystal display device having a liquid crystal layer which is sandwiched, with the liquid crystal molecules being aligned in one direction, between a pair of substrates having electrodes formed on them, and in which the tilt angle the liquid crystal molecules make with the substrates changes in accordance with an electric field applied between the electrodes, or by the use of a homogeneous type liquid crystal display device in which liquid crystal molecules are aligned in one direction.

It is another object of the present invention to provide a field sequential liquid crystal display apparatus capable of transmission display using a illuminating light beam from an illuminating unit of the display apparatus, and reflection display using external light from the external environment of a display device, and to provide a field sequential liquid crystal display apparatus which reduces the power consumption. This object can be achieved by placing a reflecting member on the side of a liquid crystal layer of the liquid crystal display device away from the side opposite to an observer, and using a controller capable of freely turning on and off the illuminating unit.

To achieve the above objects, a liquid crystal display apparatus according to a first aspect of the present invention comprises a liquid crystal display device including a pair of opposing substrates, electrodes formed to oppose each other on opposing inner surfaces of the pair of substrates, and a liquid crystal layer sandwiched between the pair of substrates with liquid crystal molecules being aligned in one direction, of which the tilt angle to the inner surfaces of the substrates changes in accordance with an electric field applied between the electrodes, in which a display element for controlling transmission of a light beam is formed by at least one region in which the electrodes oppose each other; an illuminating unit is placed on one side of the liquid crystal display device to display an arbitrary color by mixing a plurality of unit colors, the illuminating unit selectively emitting light beams having the plurality of unit colors and irradiating the liquid crystal display device with the light beams having the plurality of unit colors; and a controller sequentially supplies to the liquid crystal display device a plurality of display signals corresponding to the light beams having the plurality of unit colors emitted by the illuminating unit, in each period during which one unit color of the light beams having the plurality of unit colors is displayed, and which causes the illuminating unit to selectively emit a light beam having a unit color corresponding to the display signal in each period.

In this invention according to the first aspect, the liquid crystal display device of the field sequential liquid crystal display apparatus has the liquid crystal layer which is sandwiched with the liquid crystal molecules being aligned in one direction, and in which the tilt angle the liquid crystal molecules make with the substrates changes in accordance with an electric field applied between the electrodes. Since the structure of the liquid crystal layer is simple, the liquid crystal molecules are evenly and stably aligned. Consequently, stable operating characteristics and high-speed response characteristics can be obtained, and the fabrication is facilitated.

In this invention, the liquid crystal display device may have a homogeneously aligned nematic liquid crystal layer, as the liquid crystal layer, in which when no electric field is applied between the electrodes, liquid crystal molecules are substantially parallel to the surfaces of the substrates and pointed in one direction without being twisted. The liquid crystal display device may be a matrix type liquid crystal display device which comprises a plurality of pixel electrodes formed on one of opposing inner surfaces of opposing substrates, and at least one counterelectrode formed on the inner surface of the other substrate, and in which a plurality of pixel regions formed by regions where the pixel electrodes and the counterelectrode oppose each other are arranged in a matrix manner. Furthermore, the liquid crystal display device is desirably an active matrix display device which comprises a plurality of active elements formed on one substrate and connected in one-to-one correspondence with the plurality of pixel electrodes, a gate line for controlling operations of the active elements, and a data line which supplies a display data signal to the pixel electrodes via the active elements.

Also, in this invention, the controller may comprise a display device driver which, in order to display an arbitrary color by mixing a plurality of unit colors, sequentially supplies to the liquid crystal display device a plurality of unit-color image data signals corresponding to the plurality of unit colors in each field for displaying one of the plurality of unit colors, and sequentially writes the plurality of unit-color image data signals into the display elements of the liquid crystal display device during the period of one frame composed of a plurality of continuous fields for displaying different unit colors, and an illumination controller which selectively emits one of the plurality of unit colors in accordance with the sequential write of the unit-color image data performed for each frame by the display device driver. With this arrangement, color images and an image having one predetermined color can be displayed. Since unit-color image data is written for each frame, the write frequency lowers, and this reduces the power consumption.

In this invention, the display apparatus may further comprise a reflecting member which reflects a light beam, incident from one substrate of the liquid crystal display device and transmitted through the liquid crystal layer, toward the other substrate. This reflecting member is a semitransparent reflecting film formed between the liquid crystal layer of the liquid crystal display device and the illuminating unit, or a reflecting film formed on a side of the illuminating unit away from the liquid crystal display device. This arrangement enables reflection display using external light in the environment in which this liquid crystal display apparatus is placed. Since the illuminating unit is turned off in this reflection display, the power consumption is further reduced.

To achieve the above objects, a liquid crystal display apparatus according to a second aspect of the present invention comprises a liquid crystal display device which is formed by sandwiching a liquid crystal layer between a pair of front and rear substrates having opposing inner surfaces on which electrodes are formed, and which forms a plurality of display elements for controlling transmission of a light beam by regions where the electrodes of the pair of front and rear substrates oppose each other, a display device driver which, in order to display an arbitrary color by mixing a plurality of unit colors, sequentially supplies to the liquid crystal display device a plurality of unit-color image data signals corresponding to the plurality of unit colors in each field for displaying one of the plurality of unit colors, and sequentially writes the plurality of unit-color image data signals into the display elements of the liquid crystal display device during the period of one frame composed of a plurality of continuous fields for displaying different unit colors, an illuminating unit which has a plurality of light-emitting elements for emitting light beams having the plurality of unit colors, which is placed on the rear substrate side of the liquid crystal display device so as to allow the light beams emitted by the light-emitting elements to enter the liquid crystal display device from the rear substrate, and which can select sequential turn-on by which the light-emitting elements of the plurality of unit colors are sequentially turned on in accordance with the sequential write of the unit-color image data, and total turn-off by which all the light-emitting elements are turned off, and a reflecting member which reflects a light beam, incident from the front substrate of the liquid crystal display device and transmitted through the liquid crystal layer, toward the front substrate.

This invention according to the second aspect comprises the reflecting member which reflects a light beam transmitted through the liquid crystal layer of the liquid crystal display device toward the front substrate, and the illuminating unit capable of selecting sequential turn-on by which the light-emitting elements of the plurality of unit colors are sequentially turned on in accordance with the sequential write of the unit-color image data, and total turn-off by which all the light-emitting elements are turned off. By totally turning off this illuminating unit, therefore, it is possible to introduce external light in the environment in which the liquid crystal display apparatus is placed, and to display an image with this external light. This can reduce the power consumption.

In the liquid crystal display apparatus of this invention, the liquid crystal display device may comprise a homogeneously aligned nematic liquid crystal layer in which when no electric field is applied between the electrodes, liquid crystal molecules are aligned at a predetermined pretilt angle to surfaces of the substrates and pointed in one direction without being twisted. This liquid crystal display device may be an active matrix type liquid crystal display device which comprises a plurality of pixel electrodes formed on one of the opposing inner surfaces of the opposing substrates, and at least one counterelectrode formed on the inner surface of the other substrate, and in which a plurality of pixel regions formed by regions where the pixel electrodes and the counterelectrode oppose each other are arranged in a matrix manner.

In this invention, the reflecting member is preferably a semitransparent reflecting film formed between the liquid crystal layer of the liquid crystal display device and the illuminating unit. This makes both transmission display and reflection display possible.

In addition, the display device driver may have a black-and-white image data writing device which writes black-and-white image data into the display elements of the liquid crystal display device for each frame, and the illuminating unit has a total turn-on device which turns on all the light-emitting elements in accordance with a write of the black-and-white image data. This can lower the write frequency and hence reduce the power consumption. Also, the display device driver may have a black-and-white image data writing device which writes black-and-white image data into the display elements of the liquid crystal display device for each frame, and the illuminating unit has a total turn-off device which turns off all the light-emitting elements in accordance with a write of the black-and-white image data. Since black-and-white display can be performed by reflection type display and the write frequency can be lowered, the power consumption can be further reduced. Furthermore, the display device driver may have a monochromatic image data writing device which writes monochromatic image data for displaying a monochromatic image into the display elements of the liquid crystal display device for each frame, and the illuminating unit has a selective turn-on device which turns on at least one of the light-emitting elements having the plurality of colors in accordance with the write of the monochromatic image data. Since an image can be displayed in one predetermined color and the write frequency can be lowered, the power consumption can be further reduced.

To achieve the above objects, a liquid crystal display apparatus according to a third aspect of the present invention comprises a liquid crystal display device which is formed by sandwiching a liquid crystal layer between a pair of front and rear substrates having opposing inner surfaces on which electrodes are formed, and which forms a plurality of display elements for controlling transmission of a light beam by regions where the electrodes of the pair of front and rear substrates oppose each other, a display device driver having a unit-color image data writing device which, in order to display an arbitrary color by mixing a plurality of unit colors, sequentially supplies to the liquid crystal display device a plurality of unit-color image data signals corresponding to the plurality of unit colors for each field for displaying one of the plurality of unit colors, and sequentially writes the plurality of unit-color image data into the display elements of the liquid crystal display device during the period of one frame composed of a plurality of continuous fields for displaying different unit colors, and a monochromatic image data writing device which writes monochromatic image data for displaying an image in one predetermined color into the display element of the liquid crystal display device for each frame, an illuminating unit which has a plurality of light-emitting elements for emitting light beams having the plurality of unit colors, is placed on the rear substrate side of the liquid crystal display device so as to allow the light beams emitted by the light-emitting elements to enter the liquid crystal display device from the rear substrate, and can select sequential turn-on by which the light-emitting elements of the plurality of unit colors are sequentially turned on in accordance with a sequential write of the unit-color image data, and selective turn-on by which a light-emitting element of at least one unit color, of the plurality of light-emitting elements, which corresponds to the one predetermined color is turned on in accordance with a write of the monochromatic image data.

In this invention according to the third aspect, the display device driver comprises the monochromatic image data writing device which writes monochromatic image data for displaying an image in one predetermined color into the display elements of the liquid crystal display device, and the illuminating unit can perform selective turn-on by which at least one of the plurality of light-emitting elements which has a unit color corresponding to the one predetermined color is turned on. Since the write frequency can be lowered, the power consumption can be reduced.

In this invention, the display device driver may further have a black-and-white image data writing device which writes black-and-white image data into the display elements of the liquid crystal display device for each frame, and the illuminating unit may further have a total turn-on device which turns on all the light-emitting elements in accordance with a write of the black-and-white image data. Since black-and-white images can also be displayed and the write frequency can be lowered, the power consumption can be further reduced. Also, the liquid crystal display apparatus may further comprise a reflecting member which reflects a light beam, incident from the front side of the liquid crystal display device and transmitted through the liquid crystal layer, toward the front side, and the illuminating unit has a total turn-off device which turns off all the light-emitting elements. This arrangement makes reflection type display feasible. Since the illuminating unit is totally turned off in this reflection display, the power consumption can be further reduced.

Furthermore, the liquid crystal display device may have an arbitrary pattern display area which displays an arbitrary display pattern, and a fixed pattern display area which displays a fixed display pattern, and the illuminating unit comprises a first illuminating device which faces the arbitrary pattern display area of the liquid crystal display device, and a second illuminating device which faces the fixed pattern display area of the liquid crystal display device, at least the first illuminating device comprising a plurality of light-emitting elements which emit a plurality of unit colors. With this arrangement, one display screen can be divided into a plurality of areas, and only a necessary area can be efficiently illuminated. This can further reduce the power consumption. In this case, the first illuminating device comprises a first light guiding plate which has an exit surface which faces the arbitrary pattern display area of the liquid crystal display device and an incident end face on which a light beam of a light source is incident, and a light source which opposes the incident end face of the first light guiding plate, the second illuminating device comprises a second light guiding plate which has an exit surface which faces the fixed pattern display area of the liquid crystal display device and an incident end face on which a light beam of a light source is incident, and a light source which opposes the incident end face of the second light guiding plate, and at least the light source of the first illuminating device comprises a plurality of light-emitting elements which emit a plurality of unit colors. This arrangement is favorable in decreasing the thickness of the illuminating unit and decreasing the size of the liquid crystal display apparatus.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Liquid crystal display devices will be described below as embodiments of the present invention with reference to the accompanying drawings.

[First Embodiment]

Figure 1:
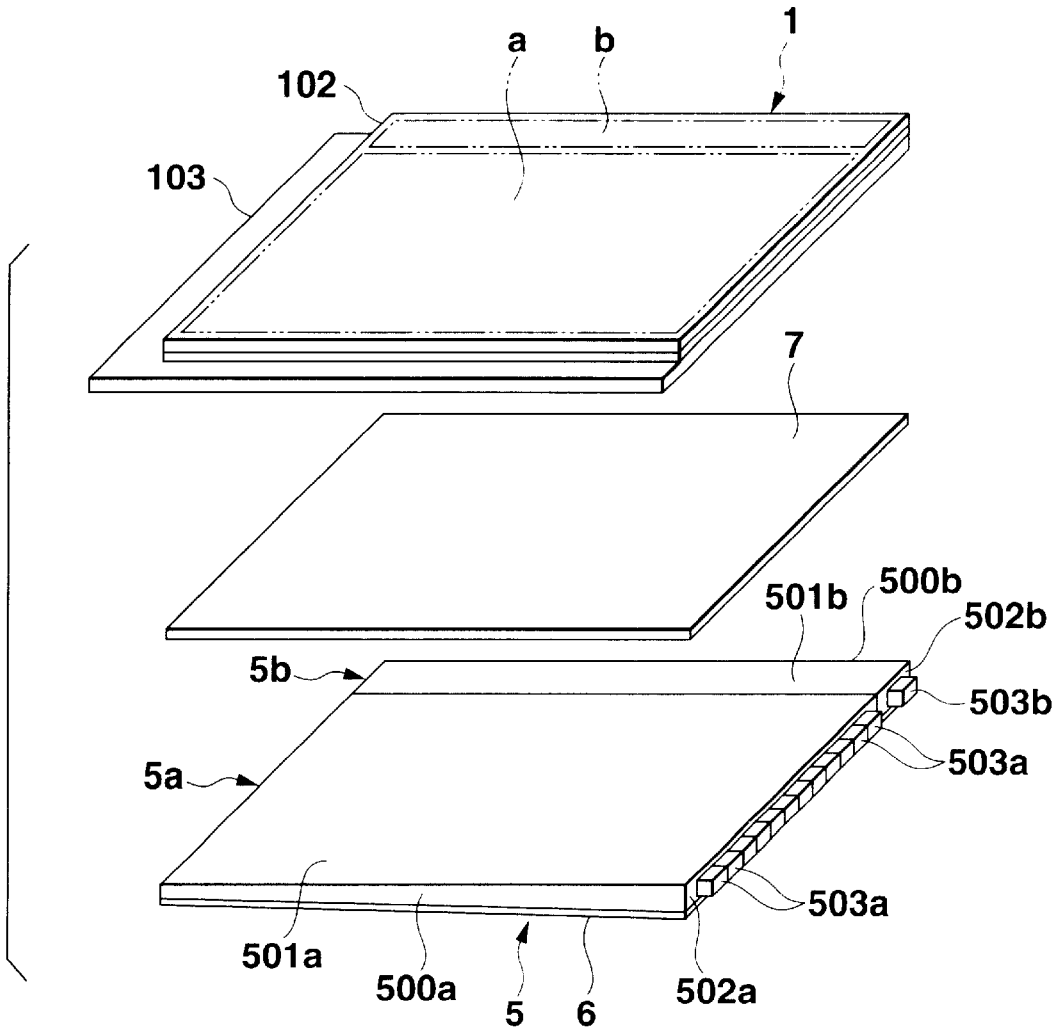
FIG. 1 is an exploded perspective view of a field sequential liquid crystal display apparatus according to the first embodiment of the present invention.

FIGS. 1 to 9 illustrate the first embodiment of the present invention. FIG. 1 is an exploded perspective view of a field sequential liquid crystal display apparatus.

As shown in FIG. 1, the field sequential liquid crystal display apparatus of the first embodiment comprises a liquid crystal display device 1, an illuminating unit 5 placed behind the liquid crystal display device 1, and a semitransparent reflecting film 7 formed between the liquid crystal display device 1 and the illuminating unit 5. This semitransparent reflecting film 7 functions as a reflecting means by which a light beam incident from a front substrate 102 as the observation side of the liquid crystal display device 1 and transmitted through a liquid crystal layer 101 (FIG. 2) of this liquid crystal display device 1 is again reflected toward the front substrate 102.

Figure 2:
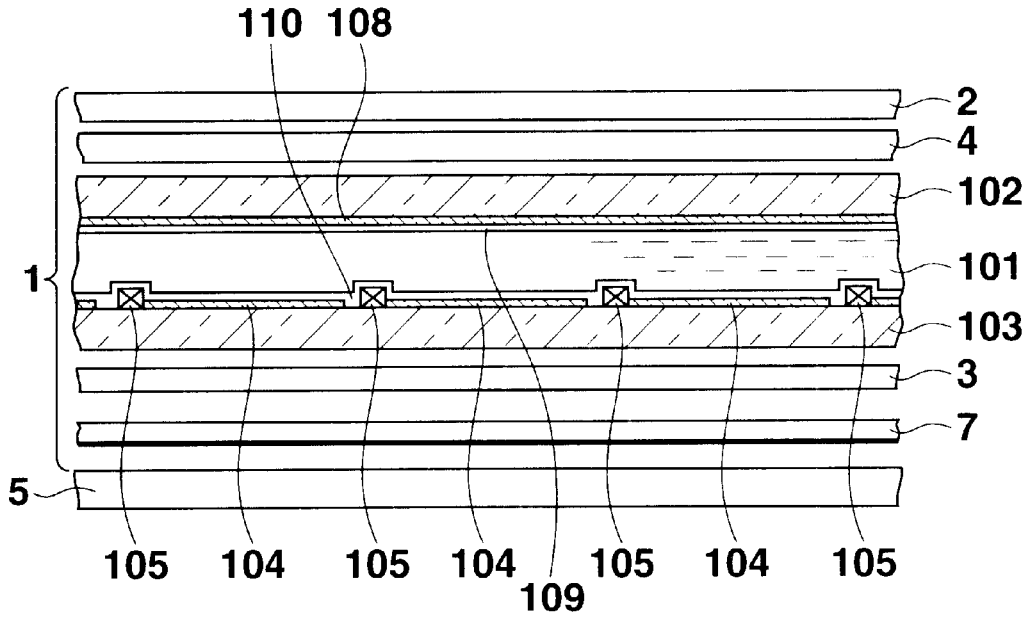
FIG. 2 is a sectional view of a portion of the field sequential liquid crystal display apparatus according to the first embodiment.

As shown in FIG. 2 which depicts the sectional structure of the liquid crystal display device 1, transparent electrodes 104 and 108 are formed on the inner surfaces of a pair of front and rear transparent substrates 102 and 103, respectively, facing each other with the liquid crystal layer 101 sandwiched between them. A region in which these electrodes 104 and 108 oppose each other forms a plurality of display elements for controlling the transmittance of a light beam. So, no color filter is included.

The liquid crystal display device 1 forms a homogeneous alignment type liquid crystal cell in which the liquid crystal layer 101, in which the liquid crystal molecules are homogeneously aligned in one direction, is sandwiched between the pair of front and rear transparent substrates 102 and 103. Polarizing plates 2 and 3 are arranged outside the pair of substrates 102 and 103, respectively. A retardation plate 4 is inserted between one of the pair of substrates 102 and 103, e.g., the front substrate 102 as the display observation side, and the polarizing plate 2 positioned outside this front substrate 102.

Figure 3:
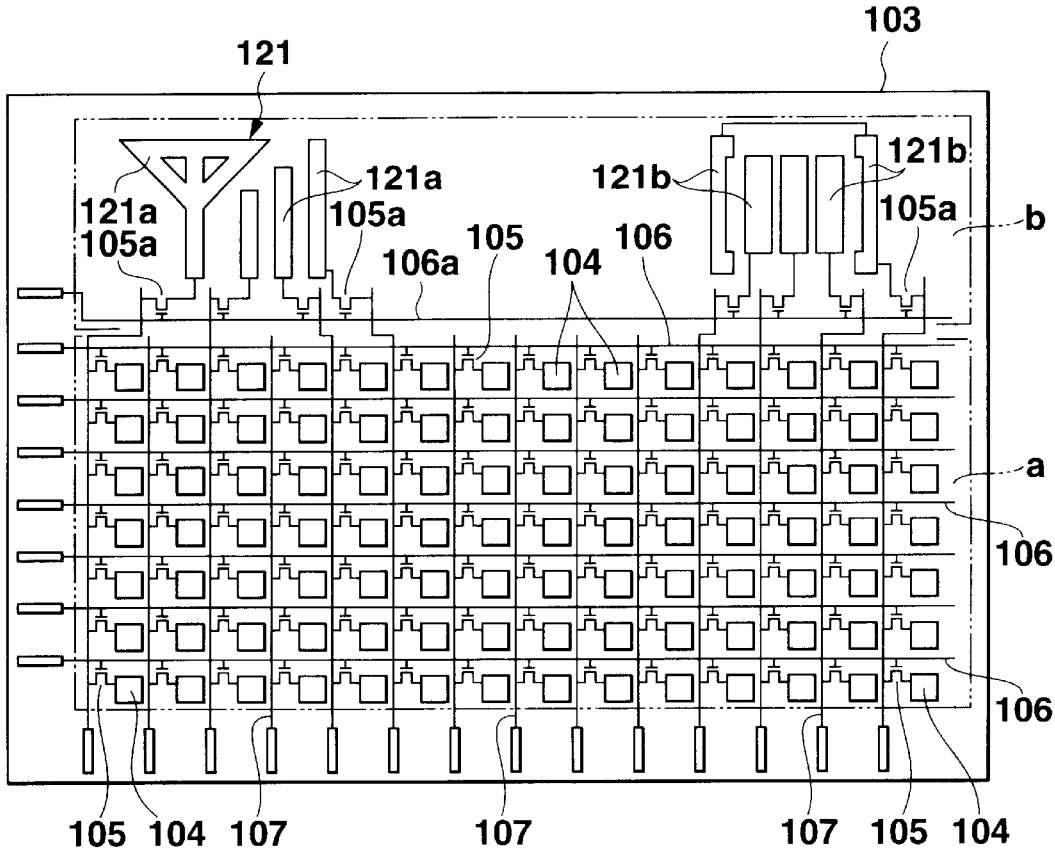
FIG. 3 is an equivalent circuit diagram of pixel electrodes, TFTs, gate lines, and data lines formed on one substrate of a liquid crystal display device.

This liquid crystal display device 1 is an active matrix type display device using TFTs (thin film transistors) 105 as active elements. As shown in FIGS. 2 and 3, on the inner surface of one of the pair of substrates 102 and 103, e.g., the rear substrate 103 opposite to the observation side, a plurality of pixel electrodes 104 arranged in a matrix manner in the row and column directions and a plurality of TFTs 105 electrically connected to these pixel electrodes 104 are formed. In addition, a plurality of gate lines 106 for supplying a gate signal to the TFTs 105 in each row and a plurality of data lines 107 for supplying a data signal to the TFTs 105 in each column are formed. On the inner surface of the other substrate, e.g., the front substrate 102, a counterelectrode 108 which is a film facing the pixel electrodes 104 is formed.

Although the TFTs 105 are omitted in FIG. 1, each TFT 105 is a thin film transistor using a thin amorphous silicon film or a thin film transistor using a thin polysilicon film. Although details are not shown, when a thin film transistor using a thin amorphous silicon film is used, the TFT 105 includes a gate electrode formed on the rear substrate 103, a transparent gate insulating film formed to cover the gate electrode on substantially the entire surface of the rear substrate 103, an i-type semiconductor film formed to oppose the gate electrode on this gate insulating film, and a source electrode and drain electrode formed on the two sides of the i-type semiconductor film via an n-type semiconductor film.

Homogeneous alignment films 109 and 110 are formed on the inner surfaces of the pair of substrates 102 and 103, respectively. These alignment films 109 and 110 are aligned substantially parallel to each other in opposite directions.

The edges of the pair of substrates 102 and 103 are joined via a frame-like sealing member (not shown). A region surrounded by the sealing member, between these substrates 102 and 103 is filled with a nematic liquid crystal having positive dielectric anisotropy. Liquid crystal molecules of the nematic liquid crystal are homogeneously aligned along the aligning treatment direction of the alignment films 109 and 110 so as to be inclined a predetermined pretilt angle to the surfaces of the substrates 102 and 103 (the surfaces of the alignment films 109 and 110).

The transmission axes of the front and rear polarizing plates 2 and 3 arranged outside the pair of substrates 102 and 103 are inclined substantially 45° to the homogeneous alignment direction of the liquid crystal molecules (the aligning treatment direction of the alignment films 109 and 110). Also, these transmission axes are made substantially perpendicular to each other.

The retardation plate 4 raises the contrast of display by adjusting the value of retardation of a light beam transmitted through the liquid crystal display device, and also widens the viewing angle. The slow axis of the retardation plate 4 is made substantially perpendicular to the homogeneous alignment direction of the liquid crystal molecules.

The homogeneous alignment type liquid crystal display device described above is a normally white type display device. That is, in accordance with the strength of an electric field applied to the liquid crystal layer, the tilt of the liquid crystal molecules arranged in one direction changes with respect to the substrate surfaces. This changes the birefringence of the liquid crystal layer, thereby controlling the retardation of a light beam transmitted through the liquid crystal layer. The transmittance is changed by detecting this change in the retardation of a light beam by the pair of polarizing plates. A liquid crystal layer thus homogeneously aligned has no twist in the arrangement of liquid crystal molecules. When the substrate spacing (liquid crystal layer thickness) is as small as 1 to 3 μm and a liquid crystal layer is formed between the substrates as in this embodiment, homogeneous alignment films formed on the substrate surfaces produce a strong alignment regulating force by which the liquid crystal molecules are arranged parallel to the substrate surfaces. When an electric field applied to the liquid crystal layer is shut off, therefore, the liquid crystal molecules are aligned parallel to the substrate surfaces in a short time. Accordingly, a liquid crystal display device having a homogeneously aligned liquid crystal layer rapidly responds to an applied electric field.

The response speed of the homogeneous alignment type liquid crystal display device of this embodiment is shown in Table 1 in comparison with a TN alignment type liquid crystal display device.

TABLE 1

| | Embodiment (homogeneous alignment) | Comparative example (TN alignment) |
|---|---|---|
| Liquid crystal layer thickness (μm) | 1.5 | 1.5 |
| Rise speed (Tr msec) | 0.8 | 0.7 |
| Decay speed (Tf msec) | 2.6 | 5.5 |

The response time is defined as a time required by the transmittance to reach 90% from the start of application of the write voltage, when the transmittance corresponding to the write voltage is 100%. In a liquid crystal having positive dielectric anisotropy, the rise speed corresponds to a time required by the liquid crystal molecules to behave in a direction, in which they rise with respect to the substrate surface, in accordance with the application of an electric field. The decay speed corresponds to a time required by the liquid crystal molecules to behave in a direction, in which they are parallel to the substrate surface, when the electric field applied to the liquid crystal layer is shut off.

As is apparent from Table 1, the response speeds of the homogeneous alignment type liquid crystal display device and the TN liquid crystal display device having the same liquid crystal layer thickness of 1.5 μm are 0.8 and 0.7 msec, respectively, i.e., have no remarkable difference, because the liquid crystal molecules behave by the interaction with an electric field. However, the decay speed of the homogeneous alignment type liquid crystal display device is 2.6 msec, i.e., substantially twice that of the TN liquid crystal display device which is 5.5 msec. This reason is that the alignment regulating force of the alignment film strongly acts on the homogeneously aligned liquid crystal molecules, so that the liquid crystal molecules rapidly behave, and, on the other hand, the twisted liquid crystal molecules of the TN liquid crystal display device take a long time to be twisted.

Accordingly, the field sequential liquid crystal display device of this embodiment is suitably a homogeneous alignment type liquid crystal display device having a liquid crystal layer in which the liquid crystal molecules are evenly aligned in one direction. The liquid crystal layer thickness is preferably 1 to 3 μm, more preferably, 1 to 2 μm, and most preferably, 1.5 μm.

The liquid crystal display device 1 has an arbitrary pattern display area a for displaying arbitrary display patterns, and a fixed pattern display area b for displaying fixed display patterns. In this embodiment, as shown in FIG. 1, of the screen area of the liquid crystal display device 1, a narrow area along the upper edge of the screen is the fixed pattern display area b, and the whole remaining area is the arbitrary pattern display area a.

FIG. 3 is an equivalent circuit diagram of the pixel electrodes, TFTs, gate lines, and data lines formed on the inner surface of the rear substrate 103 of the liquid crystal display device 1. In a region of this rear substrate 103 which corresponds to the arbitrary pattern display area a, a plurality of pixel electrodes 104 are formed in a matrix manner in the row direction (the horizontal direction of the screen) and the column direction (the vertical direction of the screen). In a region corresponding to the fixed pattern display area b, a plurality of pattern electrodes 121 are formed into shapes corresponding to the fixed display patterns so as to have a predetermined positional relationship.

The field sequential liquid crystal display apparatus of this embodiment may be packaged in, e.g., a portable telephone set. Of the pattern electrodes 121 shown in FIG. 3, a plurality of pattern electrodes 121*a* on the left side are electrodes for displaying the received signal intensity, and a plurality of pattern electrodes 121*b* on the right side are electrodes for displaying the remaining battery amount.

Although not shown in FIG. 3, in the region corresponding to the fixed pattern display area b, pattern electrodes for displaying various fixed patterns are formed in addition to the pattern electrodes 121.

Referring to FIG. 3, the pixel electrodes 104 formed in the region corresponding to the arbitrary pattern display area a are shown in enlarged scale so as to be seen easily. However, each pixel electrode 104 is a square dot electrode of 100 to 200 μm side, and each pattern electrode 121 has a width of about 0.5 mm or more.

On the inner surface of the rear substrate 103, a plurality of TFTs 105*a* and 105 are formed in one-to-one correspondence with the pixel electrodes 104 and the pattern electrodes 121, respectively. In addition, a plurality of gate lines 106 for supplying a gate signal to the TFTs 105 in each row which correspond to the pixel electrodes 104 are formed, and one gate line 106*a* for supplying a gate signal to all the TFTs 105*a* corresponding to the pattern electrodes 121 is also formed. Furthermore, a plurality of data lines 107 for supplying an image data signal to the TFTs 105 in each column which correspond to the pixel electrodes 104 and to the TFTs 105*a* corresponding to the pattern electrodes 121 are formed.

On the substrate 103, each gate line 106 is formed along one side of the corresponding pixel electrode row, and the gate line 106*a* is formed along one side of the pattern electrodes 121. Also, each data line 107 is formed along one side of the corresponding pixel electrode column, and connected to the drain electrodes of the TFTs 105 in that column which are connected to the pixel electrodes 104.

Of the data lines 107, a plurality of data lines are extended to the formation region of the TFTs 105*a* connected to the pattern electrodes 121, and are connected to the drain electrodes of these TFTs 105*a*.

On the side of the rear substrate away from the observation side of the liquid crystal display device 1, the illuminating unit 5 is placed via the semitransparent reflecting film 7. As shown in FIGS. 1 and 2, the illuminating unit 5 includes a first illuminating device 5*a* facing the arbitrary pattern display area a of the liquid crystal display device 1, and a second illuminating device 5*b* facing the fixed pattern display area b of the liquid crystal display device 1.

The first illuminating device 5*a* comprises a first light guiding plate 500*a* having an exit surface 501*a* facing the arbitrary pattern display area a of the liquid crystal display device 1 and an incident end face 502*a*, and one or a plurality of light source members 503*a* arranged to oppose the incident end face 502*a* of the first light guiding plate 500*a* in the longitudinal direction of the incident end face 502*a*. The second illuminating device 5*b* comprises a second light guiding plate 500*b* having an exit surface 501*b* facing the fixed pattern display area b of the liquid crystal display device 1 and an incident end face 502*b*, and one light source member 503*b* opposing the incident end face 502*b* of the second light guiding plate 500*b*.

Each of the light guiding plates 500*a* and 500*b* is made of a wedge-shaped transparent plate (e.g., an acrylic resin plate) having a flat front surface and an inclined rear surface which approaches the front surface in a direction from one end to the other. The front surface of the transparent plate is the exit surface 501*a* (501*b*), and one of the two end faces, which is between the front and rear surfaces and has a larger width, is the incident end face 502*a* (502*b*). On the entire rear surface of each of the light guiding plates 500*a* and 500*b*, a reflecting film 6 which is a deposited or plated film of, e.g., aluminum is formed.

Each of the light source members 503*a* and 503*b* of the first and second illuminating devices 5*a* and 5*b* includes a plurality of light-emitting elements for emitting light beams having a plurality of unit colors to display an arbitrary color by color mixing.

Figure 4:
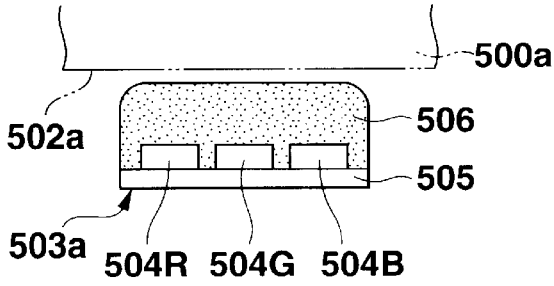
FIG. 4 is an enlarged sectional view showing light source members of an illuminating unit according to the first embodiment of the present invention.

FIG. 4 is an enlarged sectional view of the light source member 503*a* of the first illuminating device 5*a*, from which hatching is omitted. The light source member 503*b* of the second illuminating device 5*b* has the same arrangement.

This light source member 503*a* includes a light-emitting diode (to be referred to as a red LED hereinafter) 504R for emitting a unit-color light beam of red, a light-emitting diode (to be referred to as a green LED hereinafter) 504G for emitting a unit-color light beam of green, and a light-emitting diode (to be referred to as a blue LED hereinafter) 504B for emitting a unit-color light beam of blue, as a plurality of light-emitting elements for emitting light beams having the plurality of unit colors. These three LEDs 504R, 504G, and 504B are juxtaposed on a common substrate 505 and molded with a light diffusing resin 506.

Figure 5:
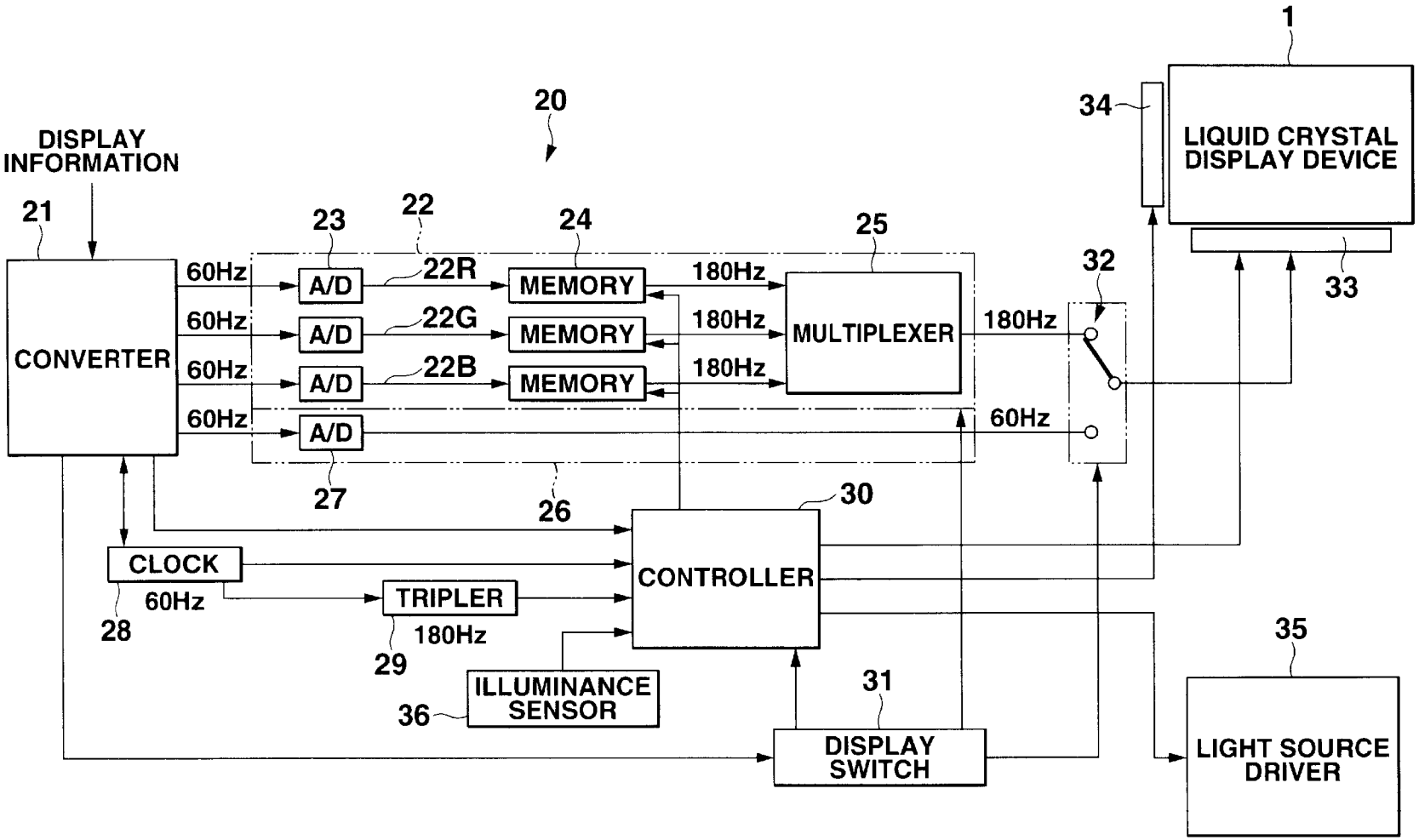
FIG. 5 is a block diagram showing a circuit configuration including the liquid crystal display device and a display device driver of the first embodiment.

The illuminating unit 5 has a light source driver 35 shown in FIG. 5. The light source driver 35 turns on the red, green, and blue LEDs 504R, 504G, and 504B of the first and second illuminating devices 5*a* and 5*b*.

In the first and second illuminating devices 5*a* and 5*b*, the light beams emitted from the red, green, and blue LEDs 504R, 504G, and 504B of the light source members 503*a* and 503*b* are incident into the light guiding plates 500*a* and 500*b* from the incident end faces 502*a* and 502*b*, and are output from the front exit surfaces 501*a* and 501*b* of these light guiding plates 500*a* and 500*b*. The output light beams from the exit surfaces 501*a* and 501*b* of the light guiding plates 500*a* and 500*b* are transmitted through the semitransparent reflecting plate 7 and incident on the arbitrary pattern display area a and the fixed pattern display area b of the liquid crystal display device 1 from the back side.

This field sequential liquid crystal display apparatus includes a display device driver 20 as shown in FIG. 5 which sequentially supplies unit-color image data corresponding to the plurality of unit colors (red, green, and blue) to the liquid crystal display device 1 in each field in which one of the plurality of unit colors is displayed, and sequentially writes the plurality of unit-color image data into the display elements of the liquid crystal display device 1 during the period of one frame composed of a plurality of continuous fields equal in number to the different unit colors.

FIG. 5 is a block diagram showing the configuration of the display device driver 20. The display device driver 20 includes a signal converter 21, unit-color image data supply system 22, and monochromatic image data supply system 26. The signal converter 21 converts a display information signal supplied from a controller of an electronic apparatus (e.g., a portable telephone set) incorporating the liquid crystal display apparatus into an image data signal corresponding to the display information, and outputs this image data signal. The unit-color image data supply system 22 and the monochromatic image data supply system 26 supply the output image data signal from the signal converter 21 to the liquid crystal display device 1.

The controller of the electronic apparatus selectively supplies to the signal converter 21 a display information signal of a color image, a display information signal of a monochromatic image, and a display information signal of a black-and-white image.

The color image display information signal is composed of luminance information and color information. The monochromatic image display information signal is composed of luminance information and color designation information. The black-and-white image display information signal is composed of luminance information and black-and-white designation information for designating black-and-white display. These display information signals are made up of a signal containing display information of both the arbitrary pattern display area a and the fixed pattern display area b of the liquid crystal display device 1, a signal containing only display information of the arbitrary pattern display area a, and a signal containing only display information of the fixed pattern display area b.

When the display information signal containing display information of the arbitrary pattern display area a is supplied, the signal converter 21 outputs an arbitrary pattern area select signal to a controller 30. When the display information signal containing display information of the fixed pattern display area b is supplied, the signal converter 21 outputs a fixed pattern area select signal to the controller 30.

When the color image display information signal is supplied, the signal converter 21 sequentially supplies unit-color image data signals of red, green, and blue, corresponding to the luminance information of unit-color images of red, green, and blue of the display information, to the unit-color image data supply system 22 in synchronism with a primary clock signal from a primary clock generator (clock) 28. In addition, the signal converter 21 outputs to the controller 30 timing signals synchronized with the sequential output of the unit-color image data signals of red, green, and blue.

When the black-and-white image display information signal is supplied, the signal converter 21 outputs to the monochromatic image data supply system 26 a black-and-white image data signal corresponding to the luminance information of the display information in synchronism with the primary clock signal. Also, the signal converter 21 outputs a black-and-white display switching signal to a display switching circuit 31.

The primary clock signal is, e.g., a clock signal having a frequency of 60 Hz. Accordingly, any of the unit-color image data signals supplied from the signal converter 21 to the unit-color image data supply system 22, and the black-and-white image data signal and the monochromatic image data signal supplied from the signal converter 2 to the monochromatic image data supply system 26, is an image data signal whose repetition frequency of display data of one frame is 60 Hz.

The unit-color image data supply system 22 comprises three image data supply systems, i.e., red, green, and blue image data supply systems 22R, 22G, and 22B for supplying unit-color image data signals of red, green, and blue, respectively, output from the signal converter 21, and a digital multiplexer 25 for sequentially selecting and outputting the image data signals of red, green, and blue from these image data supply systems 22R, 22G, and 22B, respectively.

Each of the unit-color image data supply systems 22R, 22G, and 22B of red, green, and blue includes an A/D converter 23 and a field memory 24. The A/D converter 23 converts the unit-color image data signal of red, green, or blue, output from the signal converter 21 to the image data supply system 22R, 22G, or 22B, into a digital signal. The field memory 24 stores one field of the unit-color image data signal of the corresponding color converted into a digital signal by the A/D converter 23.

The controller 30 is supplied with the primary clock signal of a frequency of 60 Hz supplied from the primary clock generator 28, and a secondary clock signal of a frequency of 180 Hz formed by multiplying the primary clock signal by 3 by a tripler 29. The controller 30 operates in accordance with timing signals output from the signal converter 21 in synchronism with the unit-color image data signals of red, green, and blue. The controller 30 sequentially outputs memory read signals of 180 Hz to the field memories 24 of the red, green, and blue image data supply systems 22R, 22G, and 22B in one-to-one correspondence with red, green, and blue fields constructing one frame.

In each of the image data supply systems 22R, 22G, and 22B of red, green, and blue, the unit-color image data signal of the corresponding color supplied from the signal converter 21 is converted into a digital signal by the A/D converter 23 and stored in the field memory 24. These unit-color image data signals of red, green, and blue stored in the field memories 24 are sequentially read out in synchronism with the memory read signals from the controller 30, and supplied to the digital multiplexer 25. Each of these unit-color image data signals of red, green, and blue output from the field memories 24 of the red, green, and blue image data supply systems 22R, 22G, and 22B to the digital multiplexer 25 is a signal having a one-frame scanning period of 1/60 sec and a field frequency of 180 Hz.

In the monochromatic data supply system 26, the black-and-white data signal or monochromatic image data signal output from the signal converter 21 is converted into a digital signal by an A/D converter 27. This image data signal is output to a data supply switch 32. The black-and-white image data signal or monochromatic image data signal output from this monochromatic image data supply system 26 to the data supply switch 32 is a signal having a one-frame scanning period of 1/60 sec and a frame frequency of 60 Hz.

The unit-color image data signal of red, green, and blue output from the digital multiplexer 25 of the unit-color image data supply system 22 is supplied, via the data supply switch 32, to a data driver 33 connected to data lines 107 of the liquid crystal display device 1. Also, the black-and-white image data signal or monochromatic image data signal output from the monochromatic image data supply system 26 is supplied to the data driver 33 via the data supply switch 32 by switching this data supply switch 32.

As shown in FIG. 5, the data supply switch 32 is normally in a state in which the unit-color image data signal of red, green, and blue from the unit-color image data supply system 22 is supplied to the data driver 33. When the black-and-white display switching signal or monochromatic display switching signal is supplied from the signal converter 21 to the display switching circuit 31, the data supply switch 32 is switched to a state in which the output black-and-white image data signal or monochromatic image data signal from the monochromatic image data supply system 26 is supplied to the data driver 33 by a switching signal from the signal converter 31.

That is, when the output signal from the signal converter 21 is the unit-color image data signal of red, green, and blue, the data supply switch 32 supplies this unit-color image data signal of red, green, and blue output from the unit-color image data supply system 22 to the data driver 33. When the output signal from the signal converter 21 is the black-and-white image data signal or monochromatic image data signal, the data supply switch 32 supplies this black-and-white image data signal or monochromatic image data signal output from the monochromatic image data supply system 26 to the data driver 33.

When supplied with the black-and-white display switching signal or monochromatic display switching signal from the signal converter 21, the display switching circuit 31 outputs an operation stop signal to the unit-color image data supply system 22, thereby halting this unit-color image data supply system 22.

Also, the display switching circuit 31 outputs to the controller 30 the black-and-white display switching signal or monochromatic display switching signal and the color information signal supplied from the signal converter 21. When neither the black-and-white display switching signal nor the monochromatic display switching signal is input, i.e., when the output signal from the signal converter 21 is the unit-color image data signal of red, green, and blue, the controller 30 supplies the timing signal of 180 Hz to a gate driver 34 connected to the gate lines 106 and 106*a* of the liquid crystal display device 1. On the other hand, when the black-and-white display switching signal or monochromatic display switching signal is input, i.e., when the output signal from the signal converter 21 is the black-and-white image data signal or monochromatic image data signal, the controller 30 supplies the timing signal of 60 Hz to the gate driver 34.

The image data signal (one of the unit-color image data signal of red, green, and blue, black-and-white image signal, and monochromatic image signal) supplied to the data driver 33 is converted into a display signal of the corresponding color by the data driver 33 and supplied to the data lines 107 of the liquid crystal display device 1. The gate driver 34 generates a gate signal from various timing signals and supplies this gate signal to the gate lines 106 and 106*a* of the liquid crystal display device 1. In this way, the image data is written in the individual display elements in the arbitrary pattern display area a and the fixed pattern display area b of the liquid crystal display device 1.

That is, when a display information signal of a color image is supplied to the signal converter 21, the display device driver 20 sequentially supplies to the data driver 33 unit-color image data signals corresponding to the three unit colors, red, green, and blue, and having a field frequency of 180 Hz, in each field which displays one of these three unit colors, red, green, and blue, thereby writing the display data into the display elements of the liquid crystal display device 1. In this manner, the display device driver 20 sequentially displays the unit-color images of red, green, and blue during the period of one frame composed of a plurality of (three) continuous fields equal in number to these unit colors and having a frame frequency of 60 Hz. When a display information signal of a black-and-white image or monochromatic image is supplied to the signal converter 21, the display device driver 20 supplies a black-and-white image data signal or monochromatic image data signal to the data driver 33 for each frame having a frame frequency of 60 Hz, and writes the signal into the display device 1, thereby displaying the black-and-white image or monochromatic image.

The controller 30 controls the light source driver 35 for turning on the LEDs 504R, 504G, and 504B of red, green, and blue, respectively, of the first and second illuminating devices 5*a* and 5*b*. That is, when neither the black-and-white display switching signal nor the monochromatic display switching signal is input (when the output signal from the signal converter 21 is the unit-color image data signal or red, green, and blue), the controller 30 outputs to the light source driver 35 the timing signal of 180 Hz and a sequential turn-on signal for the LEDs 504R, 504G, and 504B of red, green, and blue, in synchronism with the read-out of the unit-color image data signal of these colors. Also, when the black-and-white display switching signal is input (when the output signal from the signal converter 21 is the black-and-white image data signal), the controller 30 outputs to the light source driver 35 the timing signal of 60 Hz and a total turn-on signal for the LEDs 504R, 504G, and 504B of red, green, and blue. When the monochromatic display switching signal and the color information signal are input (when the output signal from the signal converter 21 is the monochromatic image data signal), the controller 30 outputs to the light source driver 35 the timing signal of 60 Hz and a selective turn-on signal for selectively turning on the LEDs 504R, 504G, and 504B of red, green, and blue in accordance with the color information.

Furthermore, the controller 30 normally outputs to the light source driver 35 a driving signal for turning on the LEDs 504R, 504G, and 504B of both the first and second illuminating devices 5*a* and 5*b*. When supplied with an arbitrary pattern area select signal from the signal converter 21 (when the display information signal supplied to the signal converter 21 contains only display information of the arbitrary pattern display area a), the controller 30 outputs to the light source driver 35 a driving signal for turning on only the LEDs 504R, 504G, and 504B of the first illuminating device 5*a*. When a fixed pattern area select signal is supplied from the signal converter 21 (when the display information signal supplied to the signal converter 21 contains only display information of the fixed pattern display area b), the controller 30 outputs to the light source driver 35 a driving signal for turning on only the LEDs 504R, 504G, and 504B of the second illuminating device 5*b*.

When the measured illuminance indicated by an illuminance signal from an illuminance sensor 36 for measuring the illuminance of the use environment of the liquid crystal display apparatus is equal to or higher than a predetermined illuminance (illuminance by which images can be displayed with sufficient brightness even in the case of reflection display using external light), the controller 30 outputs to the light source driver 35 a total turn-off signal for turning off all the LEDs 504R, 504G, and 504B.

This field sequential liquid crystal display having the above configuration can selectively display a color image, black-and-white image, and monochromatic image.

Figure 6:
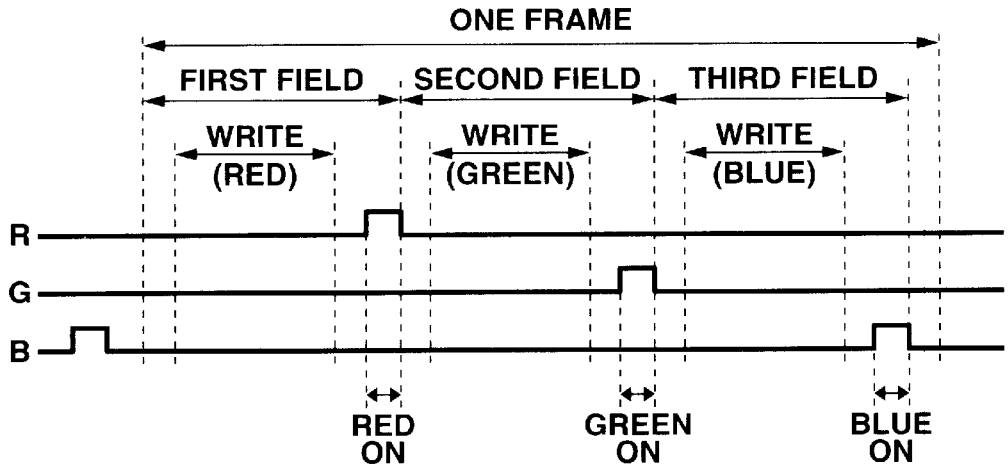
FIG. 6 is a view showing the write periods of unit-color image data of red, green and blue and the ON timings of red, green, and blue LEDs in one frame when a color image is displayed in the first embodiment.

First, the display of a color image will be explained below. FIG. 6 shows the periods in which unit-color image data of red, green, and blue are written in the display elements of the liquid crystal display device 1 and the ON timings of the LEDs 504R, 504G, and 504B in one frame when a color image is displayed. Referring to FIG. 6, reference symbol R denotes a driving signal of the red LED 504R; G, a driving signal of the green LED 504G; and B, a driving signal of the blue LED 504B.

In this color image display, as shown in FIG. 6, during the write period of a first field of three continuous fields in one frame, the unit-color image data of red are written in the display elements of the arbitrary pattern display area a and the fixed pattern display area b of the liquid crystal display device 1. After the write is completed, the red LEDs 504R of the illuminating unit 5 are turned on. During the write period of a second field, the unit-color image data of green are written in the display elements of the arbitrary pattern display area a and the fixed pattern display area b of the liquid crystal display device 1. After the write is completed, the green LEDs 504G of the illuminating unit 5 are turned on. During the write period of a third field, the unit-color image data of blue are written in the display elements of the arbitrary pattern display area a and the fixed pattern display area b of the liquid crystal display device 1. After the write is completed, the blue LEDs 504B of the illuminating unit 5 are turned on. The field frequency for writing the unit-color image data of red, green, and blue into the display elements is 180 Hz.

That is, in color image display, the aligned state of the liquid crystal molecules of the display elements in the arbitrary pattern display area a and the fixed pattern display area b of the liquid crystal display device 1 is so controlled as to transmit light beams having luminance corresponding to the unit-color image data of red, when this unit-color image data of red are written in the first field. Likewise, this aligned state is so controlled as to transmit light beams having luminance corresponding to the unit-color image data of green, when the unit-color image data of green are written in the second field, and transmit light beams having luminance corresponding to the unit-color image data of blue, when the unit-color image data of blue are written in the third field.

Accordingly, when the red LEDs 504R are turned on after the unit-color image data of red are written in the first field, the display elements display red by luminance corresponding to the transmittance of the display elements in the first field. When the green LEDs 504G are turned on after the unit-color image data of green are written in the second field, the display elements display green by luminance corresponding to the transmittance of the display elements in the second field. When the blue LEDs 504B are turned on after the unit-color image data of blue are written in the third field, the display elements display blue by luminance corresponding to the transmittance of the display elements in the third field.

In one frame, the display elements display red, green, and blue for the respective fields in this order. Therefore, in this one frame the display elements display a color image formed by temporarily mixing light beams having red, green, and blue in the first, second, and third fields, respectively, in accordance with the luminance ratio of these colors.

For example, when a light beam is transmitted in one of the three fields and almost no light beams are transmitted in the two other fields, one of three unit colors, red, green, and blue, which is the display color of the field in which a light beam is transmitted is displayed. When light beams are transmitted in two fields and a light beam is interrupted in the other field, a mixed color of any two of red, green, and blue as the display colors of the two light transmitting fields is displayed in accordance with the display luminance ratio of these two colors. When light beams are transmitted in all the fields, a mixed color of red, green, and blue as the display colors of these fields is displayed in accordance with the display luminance ratio of these three colors.

When light beams are transmitted in all the fields and red, green, and blue as the display colors of these fields have substantially the same luminance, white is displayed by even mixing of red, green, and blue. Also, black is displayed when light beams are interrupted in all the fields.

In this embodiment, the unit-color image data is written and the LEDs 504R, 504G, and 504B are turned on in the order of red, green, and blue. However, it is also possible to write the unit-color image data and turn on the LEDs 504R, 504G, and 504B in a given order.

In this color display, in the arbitrary pattern display area a of the liquid crystal display device 1, a full-color image or multi-color image is displayed by a combination of one of three unit colors, red, green, and blue, as the display color of the display elements in each field, a mixed color of two or three of these red, green, and blue, white, and black. In the fixed pattern display area b, a fixed pattern, corresponding to the shape (the shape of the pattern electrodes 121) of selected display elements in this fixed pattern display area b, is displayed in a unit color, mixed color, or black in a white background.

That is, the liquid crystal display device 1 is a normally white mode display device. To display a color image, the red, green, and blue LEDs 504R, 504G, and 504B of the first and second illuminating devices 5*a* and 5*b* are sequentially turned on every field. So, the background of the fixed pattern display area b is white.

On the other hand, the unit-color image data of red, green, and blue to be written in the display elements in the fixed pattern display area b are data by which non-selected display elements display white in one frame by even mixing of red, green, and blue, and selected display elements display one of three unit colors, red, green, and blue, a mixed color of two or three of red, green, and blue, or black. When unit-color image data like this are written, a fixed pattern is displayed in the unit color, mixed color, or black in a white background.

When a color image display information signal supplied to the signal converter 21 of the display device driver 20 contains display information of both the arbitrary pattern display area a and the fixed pattern display area b of the liquid crystal display device 1, the unit-color image data are written in the display elements of both the arbitrary pattern display area a and the fixed pattern display area b. In addition, the LEDs 504R, 504G, and 504B of both the first and second illuminating devices 5*a* and 5*b* corresponding to the arbitrary pattern display area a and the fixed pattern display area b, respectively, of the liquid crystal display device 1 are turned on to display the images in both the arbitrary pattern display area a and the fixed pattern display area b.

If the information signal contains only display information of the arbitrary pattern display area a, the unit-color image data are written only in the display elements of the arbitrary pattern display area a. In addition, only the LEDs 504R, 504G, and 504B of the first illuminating device 5*a* are turned on to display the image only in the arbitrary pattern display area a.

Alternately, if the information signal contains only display information of the fixed pattern display area b, the unit-color image data are written only in the display elements of the fixed pattern display area b. In addition, only the LEDs 504R, 504G, and 504B of the second illuminating device 5*b* are turned on to display the image only in the fixed pattern display area b.

Figure 7:
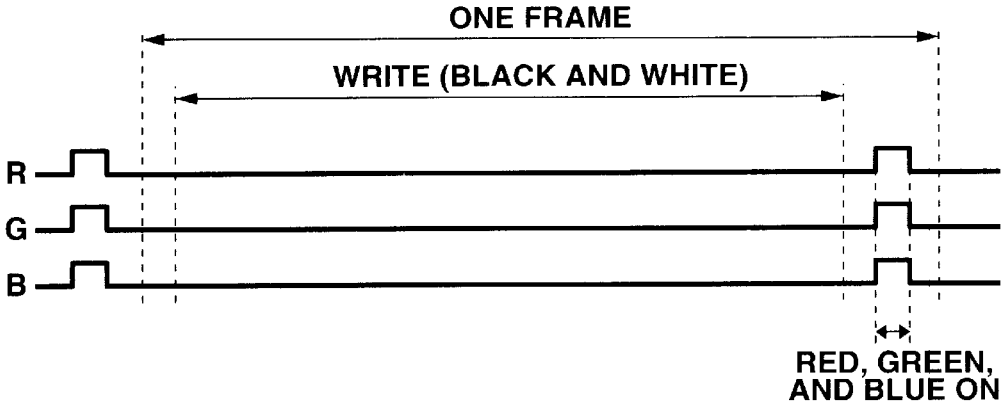
FIG. 7 is a view showing the write period of black-and-white image data and the ON timings of the red, green, and blue LEDs in one frame when a black-and-white image is displayed in the first embodiment.

Next, the display of a black-and-white image will be described below. FIG. 7 shows a period in which black-and-white image data are written in the display elements of the liquid crystal display device 1 and the ON timings of the LEDs 504R, 504G, and 504B in one frame when a black-and-white image is displayed. Referring to the figure, reference symbol R denotes a driving signal of the red LED 504R; G, a driving signal of the green LED 504G; and B, a driving signal of the blue LED 504B.

In this black-and-white image display, as shown in FIG. 7, the period of one frame composed of three continuous fields in color image display is a write period of the black-and-white image data. In each frame, the black-and-white image data are written in the display elements of the arbitrary pattern display area a and the fixed pattern display area b of the liquid crystal display device 1. After the write is completed, all the red, green, and blue LEDs 504R, 504G, and 504B of the illuminating unit 5 are turned on. The repetition frequency for writing the black-and-white image data into the display elements of the liquid crystal display device 1 is 60 Hz.

Referring to FIG. 7, the red, green, and blue LEDs 504R, 504G, and 504B are simultaneously turned on. However, the three fields of red, green, and blue may also be sequentially turned on at different timings after the black-and-white image data are written.

In this black-and-white image display, the aligned state of the liquid crystal molecules of the display elements in the arbitrary pattern display area a and the fixed pattern display area b of the liquid crystal display device 1 is so controlled, in each frame, as to transmit a light beam having luminance corresponding to the black-and-white image data when the black-and-white image data are written.

Accordingly, when all the red, green, and blue LEDs 504R, 504G, and 504B are turned on after the black-and-white image data are written in each frame, display elements so controlled as to transmit light beams display white obtained by mixing of red, green, and blue, and display elements so controlled as not to transmit light beams display black.

In this black-and-white display, therefore, in the arbitrary pattern display area a of the liquid crystal display device 1, a black-and-white image is displayed by a combination of white and black displayed by the display elements in this area in each frame. In the fixed pattern display area b, a fixed pattern, corresponding to the shape (the shape of the pattern electrodes 121) of selected display elements in this fixed pattern display area b, is displayed in black in a white background.

In this black-and-white image display, as in the color image display described above, when a color image display information signal supplied to the signal converter 21 of the display device driver 20 contains display information of both the arbitrary pattern display area a and the fixed pattern display area b of the liquid crystal display device 1, the unit-color image data are written in the display elements of both the arbitrary pattern display area a and the fixed pattern display area b. In addition, the LEDs 504R, 504G, and 504B of both the first and second illuminating devices 5*a* and 5*b* corresponding to the arbitrary pattern display area a and the fixed pattern display area b, respectively, of the liquid crystal display device 1 are turned on to display the images in both the arbitrary pattern display area a and the fixed pattern display area b.

If the information signal contains only display information of the arbitrary pattern display area a, the unit-color image data are written only in the display elements of the arbitrary pattern display area a. In addition, only the LEDs 504R, 504G, and 504B of the first illuminating device 5*a* are turned on to display the image only in the arbitrary pattern display area a.

If the information signal contains only display information of the fixed pattern display area b, the unit-color image data are written only in the display elements of the fixed pattern display area b. In addition, only the LEDs 504R, 504G, and 504B of the second illuminating device 5*b* are turned on to display the image only in the fixed pattern display area b.

In black-and-white display, the illuminance sensor 36 shown in FIG. 5 measures the illuminance of the use environment of the liquid crystal display apparatus. If this measured illuminance is higher than a predetermined illuminance (illuminance by which images can be displayed with sufficient brightness even in the case of reflection display using external light), the controller 30 outputs the total turn-off signal to the light source driver 35, thereby turning off all the LEDs 504R, 504G, and 504B.

When all the LEDs 504R, 504G, and 504B are thus turned off, light beams incident from the front side of the liquid crystal display device 1, transmitted by the liquid crystal layer, and then reflected by the semitransparent reflecting film 7 are visually perceived. This allows reflection display using external light. Even in this reflection display, a black-and-white image is displayed because the light (external light) entering from the front side of the liquid crystal display device 1 is achromatic light.

In the above embodiment, the illuminance of the use environment of the liquid crystal display apparatus is measured by the illuminance sensor 36. If this measured illuminance is equal to or higher than a predetermined illuminance, all the LEDs 504R, 504G, and 504B are turned off. However, all the LEDs 504R, 504G, and 504B can also be turned off by an operation by a display observer. When this is the case, color display in which unit-color image data of red, green, and blue is sequentially written in the display elements of the liquid crystal display device 1 in one frame or monochromatic image display in which monochromatic image data or black-and-white image data are written in the display elements of the liquid crystal display device 1 in each frame can be switched to black-and-white image display by reflection display by turning off all the LEDs 504R, 504G, and 504B of the illuminating unit 5.

Figure 8:
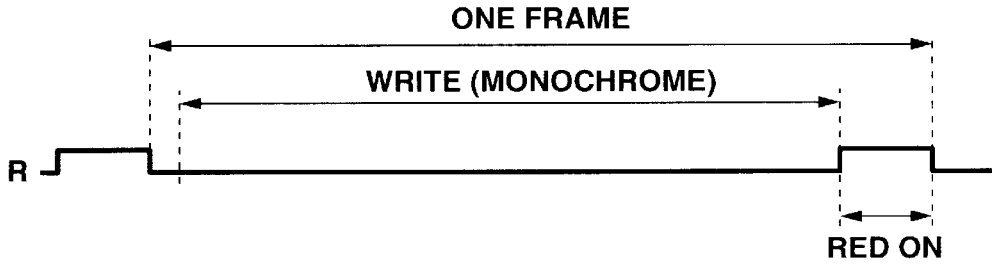
FIG. 8 is a view showing the write period of monochromatic image data and the ON timing of the red LED in one frame when a monochromatic image of red as a unit color is displayed in the first embodiment.
Figure 9:
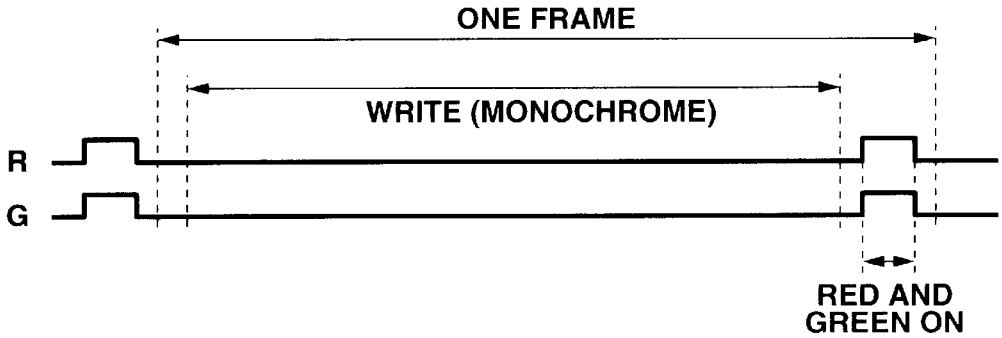
FIG. 9 is a view showing the write period of monochromatic image data and the ON timings of the red and green LEDs in one frame when a monochromatic image of a mixed color of two unit colors, red and green, is displayed in the first embodiment.

Monochromatic image display will now be explained. FIG. 8 shows a period in which monochromatic image data are written in the display elements of the liquid crystal display device 1 and the ON timing of the red LED 504R in one frame when a monochromatic image of read as a unit color is displayed. FIG. 9 shows a period in which monochromatic image data are written in the display elements of the liquid crystal display device 1 and the ON timings of the red and green LEDs 504R and 504G in one frame when a monochromatic image having a mixed color of two unit colors, red and green, is displayed. Referring to FIGS. 8 and 9, reference symbol R denotes a driving signal of the red LED 504R; and G, a driving signal of the green LED 504G.

In this monochromatic image display, similar to the black-and-white image display described above, the period of one frame composed of three continuous fields as in the above-mentioned color image display is the write period of the monochromatic image data. In each frame, the monochromatic image data are written in the display elements of the arbitrary pattern display area a and the fixed pattern display area b of the liquid crystal display device 1. The repetition frequency for writing the monochromatic image data into the display elements of the liquid crystal display device 1 is 60 Hz, as in the black-and-white image display.

To display a monochromatic image in red as a unit color, as shown in FIG. 8, after the monochromatic image data are completely written, the red LED 504R of the three, red, green, and blue LEDs 504R, 504G, and 504B of the illuminating unit 5 is selectively turned on.

In this monochromatic image display, as in the black-and-white image display described above, the aligned state of the liquid crystal molecules of the display elements in the arbitrary pattern display area a and the fixed pattern display area b of the liquid crystal display device 1 is so controlled, in each frame, as to transmit a light beam having luminance corresponding to the monochromatic image data when the monochromatic image data are written. Accordingly, when the red LED 504R is selectively turned on after the monochromatic image data are written in each frame, display elements so controlled as to transmit a light beam display red, and display elements so controlled as to transmit no light beam display black.

In this monochromatic display, therefore, in the arbitrary pattern display area a of the liquid crystal display device 1, a red monochromatic image is displayed by a combination of red and black displayed by the display elements in this area in each frame. In the fixed pattern display area b, a fixed pattern, corresponding to the shape (the shape of the pattern electrodes 121) of selected display elements in this fixed pattern display area b, is displayed in red in a white background.

The ON time of the red LED 504R is preferably equivalent to the sum of the ON times of the red, green, and blue LEDs 504R, 504G, and 504B in the color display and black-and-white display mentioned above. As a consequence, the brightness of monochromatic display by which the red LED 504R alone is selectively turned on can be made equivalent to the brightness of the display of white in the aforementioned color display and black-and-white display.

To display a monochromatic image having a mixed color of red and green, as shown in FIG. 9, after the write of the monochromatic image data is completed, the red and green LEDs 504R and 504G of the three, red, green, and blue LEDs 504R, 504G, and 504B of the illuminating unit 5 are selectively turned on.

In this monochromatic image display, as in the monochromatic image display described above, the aligned state of the liquid crystal molecules of the display elements in the arbitrary pattern display area a and the fixed pattern display area b of the liquid crystal display device 1 is so controlled, in each frame, as to transmit a light beam having luminance corresponding to the monochromatic image data when the monochromatic image data are written. Accordingly, when the red and green LEDs 504R and 504G are selectively turned on after the monochromatic image data are written in each frame, display elements so controlled as to transmit light beams display yellow as a mixed color of red and green, and display elements so controlled as to transmit no light beam display black.

In this monochromatic display, therefore, in the arbitrary pattern display area a of the liquid crystal display device 1, a red monochromatic image is displayed by a combination of yellow and black displayed by the display elements in this area in each frame. In the fixed pattern display area b, a fixed pattern, corresponding to the shape (the shape of the pattern electrodes 121) of selected display elements in this fixed pattern display area b, is displayed in yellow in a white background.

Referring to FIG. 9, the red and green LEDs 504R and 504G are simultaneously turned on. However, these red and green LEDs 504R and 504G can also be sequentially turned on after the write of the monochromatic image data is completed.

The ON time of each of the red and green LEDs 504R and 504G is preferably equivalent to substantially half the sum of the ON times of the red, green, and blue LEDs 504R, 504G, and 504B in the color display and black-and-white display mentioned above. As a consequence, the brightness of monochromatic display by which the red and green LEDs 504R and 504G alone are selectively turned on can be made equivalent to the brightness of the display of white in the aforementioned color display and black-and-white display.

In the above explanation, monochromatic display of red and monochromatic display of a mixed color (yellow) of red and green are taken as examples. However, it is also possible to display green by selectively turning on the green LED 504G, blue by selectively turning on the blue LED 504B, a mixed color (magenta) of red and blue by selectively turning on the red and blue LEDs 504R and 504B, and a mixed color (cyan) of green and blue by selectively turning on the green and blue LEDs 504G and 504B.

In the black-and-white image display and monochromatic image display explained above, the controller 30 can also control the gate driver 34 and the data driver 33 such that the repetition frequency of writing black-and-white image data or monochromatic image data into the display elements of the liquid crystal display device 1 is 90 Hz, which is lower than 180 Hz in the color display.

In the above monochromatic image display as well, when a monochromatic image display information signal supplied to the signal converter 21 of the display device driver 20 contains display information of both the arbitrary pattern display area a and the fixed pattern display area b of the liquid crystal display device 1, the unit-color image data are written in the display elements of both the arbitrary pattern display area a and the fixed pattern display area b. In addition, the LEDs 504R, 504G, and 504B of both the first and second illuminating devices 5*a* and 5*b* corresponding to the arbitrary pattern display area a and the fixed pattern display area b, respectively, of the liquid crystal display device 1 are turned on to display the images in both the arbitrary pattern display area a and the fixed pattern display area b.

If the information signal contains only display information of the arbitrary pattern display area a, the unit-color image data are written only in the display elements of the arbitrary pattern display area a. In addition, only the LEDs 504R, 504G, and 504B of the first illuminating device 5*a* are turned on to display the image only in the arbitrary pattern display area a.

If the information signal contains only display information of the fixed pattern display area b, the unit-color image data are written only in the display element of the fixed pattern display area b. In addition, only the LEDs 504R, 504G, and 504B of the second illuminating device 5*b* are turned on to display the image only in the fixed pattern display area b.

The above field sequential liquid crystal display apparatus includes the display device driver 20, the illuminating unit 5, and the semitransparent reflecting film 7. The display device driver 20 sequentially supplies to the liquid crystal display device 1 unit-color image data signals corresponding to three unit colors, red, green, and blue, in each field for displaying one of these unit colors, red, green, and blue, in order to display an arbitrary color by color mixing, and writes the unit-color image data of red, green, and blue into the display elements of the liquid crystal display device 1 during the period of one frame composed of three continuous fields equal in number to the different unit colors (red, green, and blue). The illuminating unit 5 can select sequential turn-on by which the LEDs 504R, 504G, and 504B of three unit colors, red, green, and blue, are sequentially turned on and total turn-off by which all these LEDs 504R, 504G, and 504B are turned off, in accordance with the sequential write of the unit-color image data of red, green, and blue into the display elements of the liquid crystal display device 1. The semitransparent reflecting film 7 reflects a light beam, incident from the front side of the liquid crystal display device 1 and transmitted through the liquid crystal layer of this liquid crystal display device 1, toward the front side. Therefore, this field sequential liquid crystal display apparatus can perform both transmission display which uses a light beam from the illuminating unit 5, and reflection display which uses external light which is light of the use environment of the liquid crystal display apparatus.

That is, in this field sequential liquid crystal display apparatus, the display device driver 20 sequentially writes unit-color image data of red, green, and blue into the display elements of the liquid crystal display device 1 during the period of one frame composed of three continuous fields. In accordance with this sequential write of the unit-color image data, the LEDs 504R, 504G, and 504B of the three unit colors, red, green, and blue, of the illuminating unit 5 are sequentially turned on to allow the light beam from this illuminating unit 5 to enter the liquid crystal display device 1 from its back side, thereby displaying a color image by transmission display. Also, all the LEDs 504R, 504G, and 504B of the illuminating unit 5 are turned off to perform reflection display by which the light beam incident from the front side of the liquid crystal display device 1, transmitted through the liquid crystal layer of this liquid crystal display device 1, and reflected by the semitransparent reflecting film 7 is visually perceived. In this reflection display, a black-and-white image is displayed because the light beam incident from the front side of the liquid crystal display device 1 is an achromatic light beam.

As described above, the above field sequential liquid crystal display apparatus displays a color image by transmission display by turning on all the LEDs 504R, 504G, and 504B of the three unit colors, red, green, and blue, of the illuminating unit 5, and displays a black-and-white image by reflection display by turning off all these LEDs 504R, 504G, and 504B of the illuminating unit 5. In the latter reflection display, no power is consumed to turn on the LEDs 504R, 504G, and 504B, so that the power consumption can be reduced.

This field sequential liquid crystal display apparatus uses the semitransparent reflecting film 7 as a reflecting means for reflecting a light beam, incident from the front side of the liquid crystal display device 1 and transmitted through the liquid crystal layer of this liquid crystal display device 1, toward the front side, and the semitransparent reflecting film 7 is placed between the liquid crystal display device 1 and the illuminating unit 5. This reduces the distance between the reflection surface (the front surface of the semitransparent reflecting film 7) which reflects the light beam incident from the front side of the liquid crystal display device 1 and transmitted through the liquid crystal layer of this liquid crystal display device 1, and the front surface of the liquid crystal display device 1. Accordingly, it is possible to decrease parallax between an image of the incident light beam observed on the reflection surface in reflection display using external light, and an image observed from the front side of the liquid crystal display device 1.

The field sequential liquid crystal display apparatus of the above embodiment further comprises, in the display device driver 20, a black-and-white image data writing means for writing black-and-white image data into the display elements of the liquid crystal display device 1 for each frame. Therefore, black-and-white images can also be displayed. In this black-and-white image display, black-and-white image data need only be written in the display elements of the liquid crystal display device 1 for each frame. Accordingly, the repetition frequency of the write to the liquid crystal display device 1 can be greatly lowered compared to the field frequency of color image display in which unit-color image data of red, green, and blue are sequentially written in one frame. This can lower the driving power of the liquid crystal display device 1.

In the above embodiment, the light source driver 35 of the illuminating unit 5 has a total turn-off means for turning off all the LEDs 504R, 504G, and 504B in accordance with the write of the black-and-white image data. To display a black-and-white image, therefore, reflection display which uses external light is performed. Accordingly, the driving power of the liquid crystal display device 1 can be reduced because black-and-white image data are written for each frame, and the power consumption of the illuminating unit 5 can also be reduced.

In the above embodiment, the light source driver 35 of the illuminating unit 5 further includes a total turn-on means for turning on all the LEDs 504R, 504G, and 504B in accordance with the write of the black-and-white image data. Hence, a black-and-white image can also be displayed by transmission display which uses a light beam from the illuminating unit 5.

In the above embodiment, the display device driver 20 further has a monochromatic image data writing means for writing monochromatic image data for displaying a monochromatic image into the display elements of the liquid crystal display device 1. Also, the light source driver 35 of the illuminating unit 5 has a selective turn-on means for turning on at least one of the LEDs 504R, 504G, and 504B of the three unit colors, red, green, and blue, in accordance with the write of the monochromatic image data. This makes it possible to display a monochromatic image in one of the three unit colors, red, green, and blue, or in a mixed color of two or all of these three unit colors, red, green, and blue.

In the above field sequential liquid crystal display apparatus, the liquid crystal display device 1 has the arbitrary pattern display area a for displaying arbitrary patterns, and the fixed pattern display area b for displaying fixed patterns. The illuminating unit 5 includes the first illuminating device 5*a* opposing the arbitrary pattern display area a of the liquid crystal display device 1, and the second illuminating device 5*b* opposing the fixed pattern display area b of the liquid crystal display device 1. Each of these first and second illuminating devices 5*a* and 5*b* includes the three LEDs 504R, 504G, and 504B for emitting three unit colors, red, green, and blue. Therefore, when one of the arbitrary pattern display area a and the fixed pattern display area b of the liquid crystal display device 1 is used to display an image and the other one is set in a non-display state, only the LEDs of one of the first and second illuminating devices 5*a* and 5*b* which corresponds to the display area used are turned on, and the LEDs of the other illuminating device corresponding to the other display area set in the non-display state are turned off. In this manner, the power consumption can be reduced.

In the above embodiment, as shown in FIG. 1, the first illuminating device 5*a* comprises the first light guiding plate 500*a* and the plurality of light source members 503*a*. The first light guiding plate 500*a* has the exit surface 501*a* facing the arbitrary pattern display area a of the liquid crystal display device 1, and the incident end face 502*a*. The light source members 503*a* are juxtaposed in the longitudinal direction of the incident end face 502*a* of the first light guiding plate 500*a* so as to oppose this incident end face 502*a*. The second illuminating device 5*b* comprises the second light guiding plate 500*b* and the light source member 503*b*. The second light guiding plate 500*b* has the exit surface 501*b* facing the fixed pattern display area b of the liquid crystal display device 1, and the incident end face 502*b*. The light source member 503*b* opposes the incident end face 502*b* of the second light guiding plate 500*b*. As shown in FIG. 3, each of the light source members 503*a* and 503*b* of the first and second illuminating devices 5*a* and 5*b* includes the three LEDs 504R, 504G, and 504B for emitting three unit colors, red, green, and blue. Hence, although the light source members 503*a* and 503*b* are small, the light beams emitted from the LEDs 504R, 504G, and 504B of these light source members 503*a* and 503*b* can be incident on the entire surfaces of the arbitrary pattern display area a and the fixed pattern display area b of the liquid crystal display device 1.

Furthermore, in the above embodiment, the liquid crystal display device 1 has one fixed pattern display area b. However, this liquid crystal display device 1 can also have a plurality of fixed pattern display areas.

[Second Embodiment]

Figure 10:
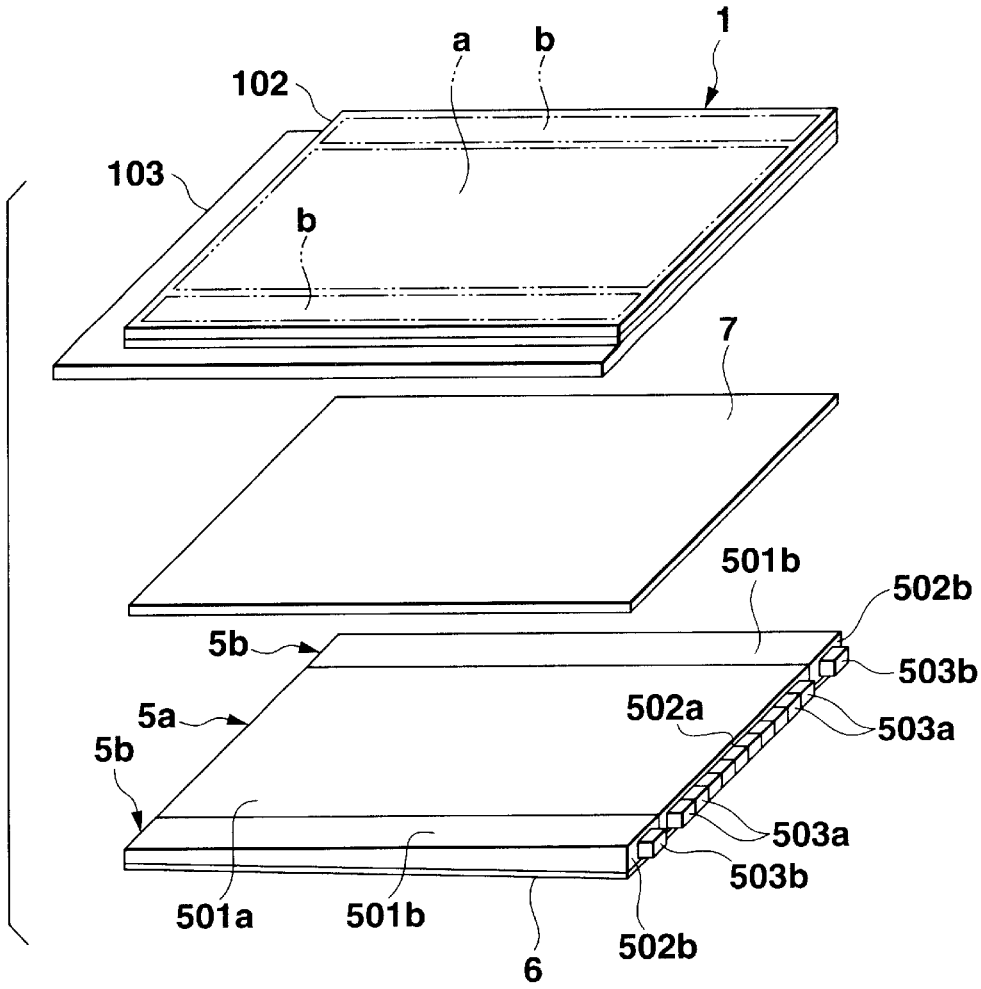
FIG. 10 is an exploded perspective view of a field sequential liquid crystal display apparatus according to the second embodiment of the present invention.

FIG. 10 is an exploded perspective view of a field sequential liquid crystal display apparatus according to the second embodiment of the present invention. In this embodiment, of the screen area of a liquid crystal display device 1, two narrow areas along the upper and lower edges of the screen are used as fixed pattern display areas b, and the whole remaining area is used as an arbitrary pattern display area a. In addition, an illuminating unit 5 is placed at the back of this liquid crystal display device 1. This illuminating unit 5 includes a first illuminating device 5*a* facing the arbitrary pattern display area a of the liquid crystal display device 1, and second illuminating devices 5*b* respectively facing the two fixed pattern display areas b of the liquid crystal display device 1. The rest of the arrangement is the same as the first embodiment described above.

In the above embodiment, a semitransparent reflecting film 7 is formed between the liquid crystal display device 1 and the illuminating unit 5. However, the semitransparent reflecting film 7 can also be formed on the inner surface of a rear substrate 103 of the liquid crystal display device 1.

A reflecting means for reflecting a light beam, incident from the front side of the liquid crystal display device 1 and transmitted through a liquid crystal layer of this liquid crystal display device 1, toward the front side is not limited to the semitransparent reflecting film 7.

[Third Embodiment]

Figure 11:
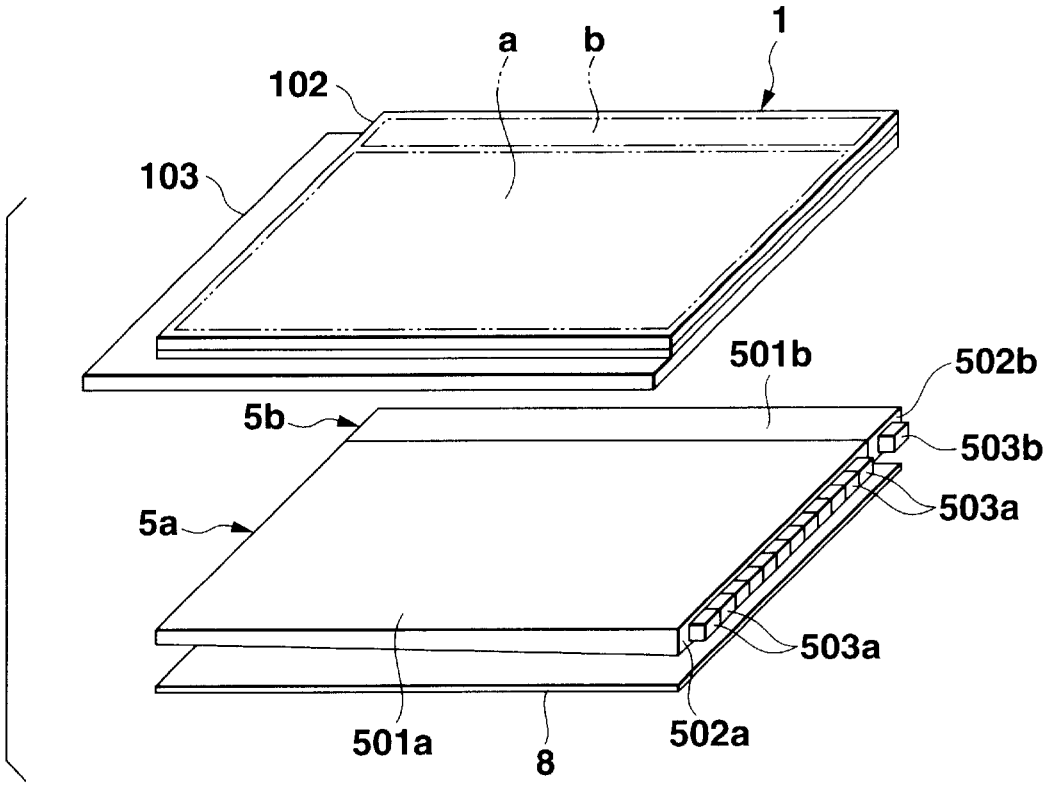
FIG. 11 is an exploded perspective view of a field sequential liquid crystal display apparatus according to the third embodiment of the present invention.

FIG. 11 is an exploded perspective view of a field sequential liquid crystal display apparatus according to the third embodiment of the present invention. In this embodiment, the reflecting film at the back of the light guiding plates 500*a* and 500*b* of the first and second illuminating devices 5*a* and 5*b* in the first embodiment is omitted. Instead, a scattering reflecting plate 8 is placed at the back of an illuminating unit 5 comprising first and second illuminating devices 5*a* and 5*b*. A light beam incident from the front side of a liquid crystal display device 1 and emerged from the back side of this liquid crystal display device 1 is transmitted through light guiding plates 500*a* and 500*b* and reflected by the scattering reflecting plate 8. The rest of the arrangement is the same as the first embodiment.

In this embodiment, the scattering reflecting plate 8 is placed at the back of the illuminating unit 5. Instead, the reflecting film 6 at the back of the light guiding plates 500*a* and 500*b* in the first embodiment can be used as a reflecting means for reflecting a light beam incident from the front side and emerged from the back side of the liquid crystal display device 1.

In each of the above embodiments, each of the first and second illuminating devices 5*a* and 5*b* includes the LEDs 504R, 504G, and 504B for emitting three unit colors, red, green, and blue. However, these LEDs 504R, 504G, and 504B for emitting three unit colors, red, green, and blue, can also be included only in the first illuminating device 5*a* facing the arbitrary pattern display area a of the liquid crystal display device 1. In this case, a light-emitting element for emitting a light beam of white or one arbitrary color is included in the second illuminating device 5*b* facing the fixed pattern display area b of the liquid crystal display device 1.

The illuminating unit at the back of the liquid crystal display device 1 is not restricted to the one having light-emitting elements (in the above embodiments, LEDs) for emitting three unit colors, red, green, and blue. For example, this illuminating unit can also include a plurality of light-emitting elements such as LEDs for emitting magenta, yellow, and cyan as unit colors. Furthermore, the light-emitting element need not be an LED but can be an EL light-emitting element using an inorganic or organic film.

The illuminating unit is not restricted to those of the above embodiments but need only have a plurality of light-emitting elements for emitting light beams having the plurality of unit colors described above. An example is a panel in which a plurality of LEDs or EL elements for emitting light beams having a plurality of unit colors are densely arranged in a matrix manner. Alternatively, a diffusing plate can be placed on the exit side of a surface light source having a cold-cathode tube unit in which very thin, straight cold-cathode tubes for emitting light beams having a plurality of unit colors are alternately arranged at very small intervals.

To perform reflection display using external light, each of the above embodiments includes a reflecting means for reflecting a light beam, incident from the front side of the liquid crystal display device 1 and transmitted through the liquid crystal layer of this liquid crystal display device 1, toward the front side. However, this reflecting means can also be omitted.

Even when this reflecting means is omitted, the above field sequential liquid crystal display apparatus includes the display device driver 20 and the illuminating unit 5. The display device driver 20 has the color image data writing means for sequentially writing unit-color image data of red, green, and blue into the display elements of the liquid crystal display device 1 in one frame composed of a plurality of fields, and the monochromatic image data writing means for writing monochromatic image data into the display elements of the liquid crystal display device 1 for each frame. The illuminating unit 5 can select sequential turn-on by which the LEDs 504R, 504G, and 504B of three unit colors, red, green, and blue, are sequentially turned on in accordance with the sequential write of the color image data of red, green, and blue, or selective turn-on by which at least one unit-color LED of these LEDs 504R, 504G, and 504B is turned on in accordance with the write of the monochromatic image data. Accordingly, both color images and monochromatic images can be displayed. Since the electric power for turning on the LEDs 504R, 504G, and 504B is small in the monochromatic image display, the power consumption can be reduced.

In this field sequential liquid crystal display apparatus, the display device driver 20 further comprises the black-and-white image data writing means for writing black-and-white image data into the display elements of the liquid crystal display device 1 for each frame. The light source driver 35 of the illuminating unit 5 further comprises the total turn-on means for turning on all the LEDs LED 504R, 504G, and 504B in accordance with the write of the black-and-white image data. Therefore, black-and-white images can also be displayed as well as color images and monochromatic images.

The field sequential liquid crystal display apparatus of each of the above embodiments includes the normally white mode, homogeneous alignment type liquid crystal display device 1. However, this liquid crystal display device 1 can also be a normally black mode display device. Also, the liquid crystal display device 1 used in the field sequential liquid crystal display apparatus of each of the above embodiments has the phase plate 4 between the polarizing plate 2 and the front substrate 102 of the liquid crystal cell formed by joining the pair of substrates 102 and 103. However, no phase plate need be used provided that the value of $\Delta nd$ (the product of the value of refractive index anisotropy of a liquid crystal and the thickness of a liquid crystal layer) of the liquid crystal layer is set such that the retardation of a light beam transmitted through the liquid crystal display device is normally white or normally black between the pair of polarizing plates 2 and 3. Alternatively, a plurality of phase plates can be arranged such that the value of And of the liquid crystal layer and the retardation of the phase plate meet the above conditions. In this case, the phase plates can be arranged before and after the liquid crystal cell to sandwich this liquid crystal cell.

In the above embodiments, the field sequential liquid crystal display apparatus capable of reflection type display and transmission type display is characterized by comprising a reflecting member and a controller for turning off all light source members different in color of an illuminating unit. Also, the field sequential liquid crystal display apparatus capable of color display and black-and-white display or monochromatic display is characterized by comprising an illuminating unit and a controller by which the ON states of light source members of the illuminating unit can be controlled. Therefore, a liquid crystal display device applied to the field sequential liquid crystal display device capable of reflection type display and transmission type display and field sequential liquid crystal display device capable of color display and black-and-white display or monochromatic display is not limited to the above-mentioned homogeneous alignment type liquid crystal display device. For example, this liquid crystal display device can be a normally white mode TN (Twisted Nematic) type liquid crystal display device which has a liquid crystal layer in which liquid crystal molecules are twisted at a twist angle of substantially 90° while the alignment direction near the pair of substrates 102 and 103 is regulated by alignment films formed on the inner surfaces of these substrates, and in which polarizing plates are arranged on the outer surfaces of the pair of substrates 102 and 103 such that the transmission axes of these polarizing plates are substantially perpendicular to each other. Furthermore, the liquid crystal display device can use an antiferroelectric liquid crystal.

The apparatus of the present invention it not restricted to an active matrix apparatus using TFTs as active elements, but can be an active matrix apparatus using MIMs as active elements or a simple matrix apparatus.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A liquid crystal display apparatus comprising:

a liquid crystal display device including a pair of opposing substrates, electrodes formed to oppose each other on opposing inner surfaces of said pair of substrates, a liquid crystal layer sandwiched between said pair of substrates with liquid crystal molecules whose tilt angle relative to the inner surfaces of said substrates changes in accordance with an electric field applied between said electrodes, wherein the liquid crystal molecules are homogeneously aligned substantially parallel to said inner surfaces of said substrates and pointed in one direction without being twisted, when no electric field is applied between said electrodes, a display element for controlling transmission of a light beam formed by at least one region in which said electrodes oppose each other;

an illuminating unit placed on one side of said liquid crystal display device to display an arbitrary color by mixing a plurality of unit colors, wherein said illuminating unit selectively emits light beams having the plurality of unit colors and irradiates said liquid crystal display device with the light beams having the plurality of unit colors; and a controller which sequentially supplies to said liquid crystal display device a plurality of display signals corresponding to the light beams having the plurality of unit colors emitted by said illuminating unit, in each period during which one unit color of the light beams having the plurality of unit colors is displayed, and which causes said illuminating unit to selectively emit a light beam having a unit color corresponding to the display signal in each period.

2. The apparatus according to claim 1, wherein said opposing electrodes comprise:

a plurality of pixel electrodes formed on a first one of said opposing inner surfaces of said opposing substrates, and at least one counterelectrode formed on the inner surface of a second one of said opposing inner surfaces of said opposing substrates, wherein a plurality of pixel regions formed by regions where said pixel electrodes and said counterelectrode oppose each other are arranged in a matrix manner.

3. The apparatus according to claim 2, wherein said liquid crystal display device comprises an active matrix display device which comprises:

a plurality of active elements formed on one of said opposing substrates and connected in one-to-one correspondence with said plurality of pixel electrodes, control lines for controlling operations of said active elements, and data lines which supply a display data signal to said pixel electrodes via said active elements.

4. The apparatus according to claim 1, wherein said controller comprises:

a display device driver which, in order to display an arbitrary color by mixing a plurality of unit colors, sequentially supplies to said liquid crystal display device a plurality of unit-color image data signals corresponding to the plurality of unit colors in each field for displaying one of the plurality of unit colors, and sequentially writes the plurality of unit-color image data signals into said display elements of said liquid crystal display device during a period of one frame composed of a plurality of continuous fields for displaying different unit colors, and an illumination controller which selectively emits one of the plurality of unit colors in accordance with the sequential writing of the unit-color image data performed for each frame by said display device driver.

5. The apparatus according to claim 1, further comprising:

a reflecting member which reflects a light beam which is, incident from one substrate of said liquid crystal display device and transmitted through said liquid crystal layer, toward the other substrate, wherein said controller comprises a turn-off device which turns off all the unit colors of said illuminating unit.

6. The apparatus according to claim 5, wherein said reflecting member comprises a semitransparent reflecting film formed between said liquid crystal layer of said liquid crystal display device and said illuminating unit.

7. The apparatus according to claim 5, wherein said reflecting member comprises a reflecting film formed on a side of said illuminating unit away from said liquid crystal display device.

8. A liquid crystal display apparatus comprising:

a liquid crystal display device which is formed by sandwiching a liquid crystal layer between a pair of front and rear substrates having opposing inner surfaces on which electrodes are formed, and which forms a plurality of display elements for controlling transmission of a light beam by regions where said electrodes of said pair of front and rear substrates oppose each other;

a display device driver which, in order to display an arbitrary color by mixing a plurality of unit colors, sequentially supplies to said liquid crystal display device a plurality of unit-color image data signals corresponding to the plurality of unit colors in each field for displaying one of the plurality of unit colors, and sequentially writes the plurality of unit-color image data signals into said display elements of said liquid crystal display device during a period of one frame composed of a plurality of continuous fields for displaying different unit colors;

an illuminating unit which has a plurality of light-emitting elements for emitting light beams having the plurality of unit colors, which is placed on a rear substrate side of said liquid crystal display device so as to allow the light beams emitted by said light-emitting elements to enter said liquid crystal display device from said rear substrate, and which can select (i) sequential turn-on by which said light-emitting elements of the plurality of unit colors are sequentially turned on in accordance with sequential writing of the unit-color image data, and (ii) total turn-off by which all said light-emitting elements are turned off to display a black-and-white image by reflection display, during said sequential writing of the unit-color image data; and a reflecting member which reflects a light beam, incident from said front substrate of said liquid crystal display device and transmitted through said liquid crystal layer, toward said front substrate.

9. The apparatus according to claim 8, wherein said liquid crystal layer comprises a homogeneously aligned nematic liquid crystal layer in which when no electric field is applied between said electrodes, liquid crystal molecules are aligned at a predetermined pretilt angle relative to said inner surfaces of said substrates and pointed in one direction without being twisted.

10. The apparatus according to claim 8, wherein said liquid crystal display device comprises an active matrix type liquid crystal display device, wherein said electrodes comprise a plurality of pixel electrodes formed on a first one of said opposing inner surfaces of said opposing substrates, and formed on a second one of said inner surfaces of said opposing substrates, and wherein a plurality of pixel regions formed by regions where said pixel electrodes and said counterelectrode oppose each other are arranged in a matrix manner.

11. The apparatus according to claim 8, wherein said reflecting member comprises a semitransparent reflecting film formed between said liquid crystal layer of said liquid crystal display device and said illuminating unit.

12. The apparatus according to claim 8, wherein said display device driver includes a black-and-white image data writing device which writes black-and-white image data into said display elements of said liquid crystal display device for each frame, and said illuminating unit includes a total turn-on device which turns on all said light-emitting elements in accordance with a writing of the black-and-white image data.

13. The apparatus according to claim 8, wherein said display device driver includes a black-and-white image data writing device which writes black-and-white image data into said display elements of said liquid crystal display device for each frame, and said illuminating unit includes a total turn-off device which turns off all said light-emitting elements in accordance with a writing of the black-and-white image data.

14. The apparatus according to claim 8, wherein said display device driver includes a monochromatic image data writing device which writes monochromatic image data for displaying a monochromatic image into said display elements of said liquid crystal display device for each frame, and said illuminating unit includes a selective turn-on device which turns on at least one of said light-emitting elements in accordance with the writing of the monochromatic image data.

15. A liquid crystal display apparatus comprising:

a liquid crystal display device which is formed by sandwiching a liquid crystal layer between a pair of front and rear substrates having opposing inner surfaces on which electrodes are formed, and which forms a plurality of display elements for controlling transmission of a light beam by regions where said electrodes of said pair of front and rear substrates oppose each other;

a display device driver having (i) a unit-color image data writing device which, in order to display an arbitrary color by mixing a plurality of unit colors, sequentially supplies to said liquid crystal display device a plurality of unit-color image data signals corresponding to the plurality of unit colors for each field for displaying one of the plurality of unit colors, and sequentially writes the plurality of unit-color image data into said display elements of said liquid crystal display device during a period of one frame composed of a plurality of continuous fields for displaying different unit colors, and (ii) a monochromatic image data writing device which writes monochromatic image data for displaying an image in one predetermined color into said display element of said liquid crystal display device for each frame;

an illuminating unit which has a plurality of light-emitting elements for emitting light beams having the plurality of unit colors, which is placed on a rear substrate side of said liquid crystal display device so as to allow the light beams emitted by said light-emitting elements to enter said liquid crystal display device from said rear substrate, and which can select (i) sequential turn-on by which said light-emitting elements of the plurality of unit colors are sequentially turned on in accordance with a sequential writing of the unit-color image data, and (ii) selective turn-on by which at least one of said plurality of light-emitting elements which has a unit color corresponding to the one predetermined color is turned on in accordance with a writing of the monochromatic image data, during said sequential writing of the unit-color image data.

16. The apparatus according to claim 15, wherein said display device driver includes a black and-white image data writing device which writes black-and-white image data into said display elements of said liquid crystal display device for each frame, and said illuminating unit includes a total turn-on device which turns on all said light-emitting elements in accordance with a writing of the black-and-white image data.

17. The apparatus according to claim 15, further comprising:

a reflecting member which reflects a light beam, which is incident from a front side of said liquid crystal display device and transmitted through said liquid crystal layer, toward the front side, wherein said illuminating unit includes a total turn-off device which turns off all said light-emitting elements.

18. The apparatus according to claim 15, wherein said liquid crystal display device comprises:

an arbitrary pattern display area which displays an arbitrary display pattern, and a fixed pattern display area which displays a fixed display pattern, and wherein said illuminating unit comprises:

a first illuminating device which faces the arbitrary pattern display area of said liquid crystal display device, and a second illuminating device which faces the fixed pattern display area of said liquid crystal display device, wherein at least said first illuminating device comprises a plurality of light-emitting elements which emit a plurality of unit colors.

19. The apparatus according to claim 18, wherein said first illuminating device comprises:

a first light guiding plate which has an exit surface which faces the arbitrary pattern display area of said liquid crystal display device and an incident end face on which a light beam of a light source is incident, and a light source which opposes the incident end face of said first light guiding plate, wherein said second illuminating device comprises:

a second light guiding plate which has an exit surface which faces the fixed pattern display area of said liquid crystal display device and an incident end face on which a light beam of a light source is incident, and a light source which opposes the incident end face of said second light guiding plate, and wherein at least said light source of said first illuminating device comprises a plurality of light emitting elements which emit a plurality of unit colors.

* * * * *